US011318340B1

(12) United States Patent
Lagree et al.

(10) Patent No.: US 11,318,340 B1
(45) **Date of Patent: *May 3, 2022**

(54) PILATES MACHINE TENSION DEVICE SUPPORT SYSTEM

(71) Applicant: Lagree Technologies, Inc., Chatsworth, CA (US)

(72) Inventors: Sebastien Anthony Louis Lagree, Chatsworth, CA (US); John C. Hamilton, Santa Clarita, CA (US)

(73) Assignee: Lagree Technologies, Inc., Chatsworth (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/062,816

(22) Filed: Oct. 5, 2020

Related U.S. Application Data

(63) Continuation of application No. 16/221,792, filed on Dec. 17, 2018, now Pat. No. 10,792,528, which is a continuation of application No. 16/036,816, filed on Jul. 16, 2018, now Pat. No. 10,155,129, which is a continuation of application No. 15/871,834, filed on Jan. 15, 2018, now Pat. No. 10,022,577, which is a (Continued)

(51) Int. Cl.

| | |
|---|---|
| ***A63B 21/00*** | (2006.01) |
| ***A63B 21/02*** | (2006.01) |
| ***A63B 21/04*** | (2006.01) |
| ***A63B 21/055*** | (2006.01) |
| ***A63B 22/00*** | (2006.01) |
| ***A63B 23/02*** | (2006.01) |

(52) U.S. Cl.
CPC ..... *A63B 21/00065* (2013.01); *A63B 21/023* (2013.01); *A63B 21/0428* (2013.01); *A63B 21/0442* (2013.01); *A63B 21/0552* (2013.01); *A63B 21/0557* (2013.01); *A63B 21/154* (2013.01); *A63B 21/4033* (2015.10); *A63B 21/4035* (2015.10); *A63B 21/4045* (2015.10); *A63B 22/0089* (2013.01); *A63B 23/02* (2013.01)

(58) Field of Classification Search
CPC ..... A63B 22/0076–0089; A63B 22/20–208
See application file for complete search history.

(56) References Cited

U.S. PATENT DOCUMENTS

| | | | |
|---|---|---|---|
| 131,886 | A | 10/1872 | Little |
| 362,700 | A | 5/1887 | Ball |

(Continued)

FOREIGN PATENT DOCUMENTS

WO 2004/096376 A1 11/2004

*Primary Examiner* — Nyca T Nguyen
(74) *Attorney, Agent, or Firm* — Neustel Law Offices

(57) ABSTRACT

A Pilates machine tension device support system for efficiently providing a tension force to a movable platform of an exercise machine. The Pilates machine tension device support system generally includes a frame, a platform movably positioned upon the frame and a tension assembly connected between the frame and the platform to provide selective tension upon the platform in a first direction. The tension assembly is comprised of a plurality of pulleys and a plurality of tension devices positioned upon the pulleys, wherein the tension devices are attached between a frame and the platform. The tension members are selectively engaged to the platform to increase or decrease the tension applied to the platform for varying levels of workouts.

20 Claims, 21 Drawing Sheets

Related U.S. Application Data continuation of application No. 15/688,417, filed on Aug. 28, 2017, now Pat. No. 9,868,010, which is a continuation of application No. 15/595,429, filed on May 15, 2017, now Pat. No. 9,744,395, which is a continuation of application No. 15/419,610, filed on Jan. 30, 2017, now Pat. No. 9,649,527, which is a continuation of application No. 15/332,674, filed on Oct. 24, 2016, now Pat. No. 9,555,282, which is a continuation of application No. 15/068,889, filed on Mar. 14, 2016, now Pat. No. 9,474,927, which is a continuation of application No. 14/066,402, filed on Oct. 29, 2013, now Pat. No. 9,283,422.

(60) Provisional application No. 61/719,763, filed on Oct. 29, 2012, provisional application No. 61/719,757, filed on Oct. 29, 2012.

(56) References Cited

U.S. PATENT DOCUMENTS 382,319 A 5/1888 Norton
1,621,477 A 8/1925 Pilates
3,770,267 A 11/1973 McCarthy
3,806,094 A 4/1974 Harken
4,759,540 A 7/1988 Yu
4,798,378 A 1/1989 Jones
5,066,005 A 11/1991 Luecke
5,263,913 A 11/1993 Boren
5,295,935 A 3/1994 Wang
5,681,249 A 10/1997 Endelman
5,885,197 A 3/1999 Barton
5,967,955 A 10/1999 Westfall
6,045,491 A 4/2000 McNergney
6,071,217 A * 6/2000 Barnett ..... A63B 21/0552 482/121
6,179,753 B1 1/2001 Barker
7,163,500 B2 1/2007 Endelman
7,803,095 B1 * 9/2010 LaGree ..... A63B 22/0012 482/140
7,931,570 B2 4/2011 Hoffman
8,137,247 B2 3/2012 Gerschefske
8,500,611 B2 8/2013 Hoffman
8,506,462 B2 8/2013 Gregor
8,585,554 B2 11/2013 Shavit
8,641,585 B2 2/2014 Lagree
9,101,790 B2 8/2015 Parnell
9,199,123 B2 12/2015 Solow
9,254,407 B2 2/2016 Savarino
10,426,991 B2 * 10/2019 Barnett ..... A63B 21/0552
2001/0056011 A1 12/2001 Endelman
2003/0119635 A1 6/2003 Arbuckle
2004/0043873 A1 3/2004 Wilkinson
2005/0130810 A1 6/2005 Sands
2005/0164856 A1 7/2005 Parmater
2006/0046914 A1 3/2006 Endelman
2006/0199712 A1 9/2006 Barnard
2008/0070765 A1 3/2008 Brown
2008/0248935 A1 10/2008 Solow
2010/0216612 A1 * 8/2010 Graham ..... A63B 22/203 482/121
2010/0227748 A1 9/2010 Campanaro
2010/0323857 A1 12/2010 D'Silva
2011/0143898 A1 6/2011 Trees
2011/0166002 A1 7/2011 Savsek
2011/0172069 A1 7/2011 Gerschefske
2012/0295771 A1 11/2012 Lagree
2014/0011645 A1 1/2014 Johnson
2014/0121076 A1 5/2014 Lagree
2014/0121079 A1 5/2014 Lagree
2014/0141948 A1 5/2014 Aronson
2015/0065320 A1 3/2015 Anderson
2015/0246263 A1 9/2015 Campanaro

* cited by examiner

PILATES MACHINE TENSION DEVICE SUPPORT SYSTEM

CROSS REFERENCE TO RELATED APPLICATIONS

The present application is a continuation of U.S. application Ser. No. 16/221,792 filed on Dec. 17, 2018 which issues as U.S. Pat. No. 10,792,528 on Oct. 6, 2020, which is a continuation of U.S. application Ser. No. 16/036,816 filed on Jul. 16, 2018 now issued as U.S. Pat. No. 10,155,129, which is a continuation of U.S. application Ser. No. 15/871,834 filed on Jan. 15, 2018 now issued as U.S. Pat. No. 10,022,577, which is a continuation of U.S. application Ser. No. 15/688,417 filed on Aug. 28, 2017 now issued as U.S. Pat. No. 9,868,010, which is a continuation of U.S. application Ser. No. 15/595,429 filed on May 15, 2017 now issued as U.S. Pat. No. 9,744,395, which is a continuation of U.S. application Ser. No. 15/419,610 filed on Jan. 30, 2017 now issued as U.S. Pat. No. 9,649,527, which is a continuation of U.S. application Ser. No. 15/332,674 filed on Oct. 24, 2016 now issued as U.S. Pat. No. 9,555,282, which is a continuation of U.S. application Ser. No. 15/068,889 filed on Mar. 14, 2016 issued as U.S. Pat. No. 9,474,927, which is a continuation of U.S. application Ser. No. 14/066,402 filed on Oct. 29, 2013 issued as U.S. Pat. No. 9,283,422, which claims priority to U.S. Provisional Application No. 61/719,763 filed Oct. 29, 2012 and U.S. Provisional Application No. 61/719,757 filed Oct. 29, 2012. Each of the aforementioned patent applications, and any applications related thereto, is herein incorporated by reference in their entirety.

STATEMENT REGARDING FEDERALLY SPONSORED RESEARCH OR DEVELOPMENT

Not applicable to this application.

BACKGROUND OF THE INVENTION

Field of the Invention

The present invention relates generally to a Pilates exercise machine and more specifically it relates to a Pilates machine tension device support system for efficiently providing a tension force to a movable platform of an exercise machine.

Description of the Related Art

Any discussion of the related art throughout the specification should in no way be considered as an admission that such related art is widely known or forms part of common general knowledge in the field.

Exercise machines such as Pilates machines support a platform that is movable along a longitudinal path with tension springs attached between one end of the exercise machine and the platform. U.S. Pat. No. 7,803,095 to Sebastien Lagree discloses an exemplary exercise machine comprised of a Pilates machine that utilizes a platform attached to a plurality of tension springs. FIGS. 1, 2, 3 and 9 of U.S. Pat. No. 7,803,095 illustrate how the tension springs are attached between the movable platform and the end of the frame of the Pilates machine.

The main problem with conventional tension spring systems utilized on Pilates machines is that when the user moves the platform away from the end of the machine where the tension springs are connected, the tension springs are fully exposed to the user while they perform their exercise. When the tension springs are exposed during operation, the exercise machine is not as aesthetically pleasing to the user or others. Furthermore, there is a risk that the user may accidentally engage the tension springs resulting in an injury. In addition, the stretching of the tension springs prevents the usage of the area below the platform in the initial position for storage of exercise related devices (e.g. hand weights, cables and the like). Also, when the movable platform is extended away from the end of the exercise machine, the tension springs are exposed and noise from the springs is free to be emitted without obstruction thereby reducing the peacefulness of the exercise.

Because of the inherent problems with the related art, there is a need for a new and improved Pilates machine tension device support system for efficiently providing a tension force to a movable platform of an exercise machine.

BRIEF SUMMARY OF THE INVENTION

The invention generally relates to a Pilates exercise machine which includes a frame, a platform movably positioned upon the frame and a tension assembly connected between the frame and the platform to provide selective tension upon the platform in a first direction. The tension assembly is comprised of a plurality of pulleys and a plurality of tension devices positioned upon the pulleys, wherein the tension devices are attached between a frame and the platform. The tension members are selectively engaged to the platform to increase or decrease the tension applied to the platform for varying levels of workouts.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
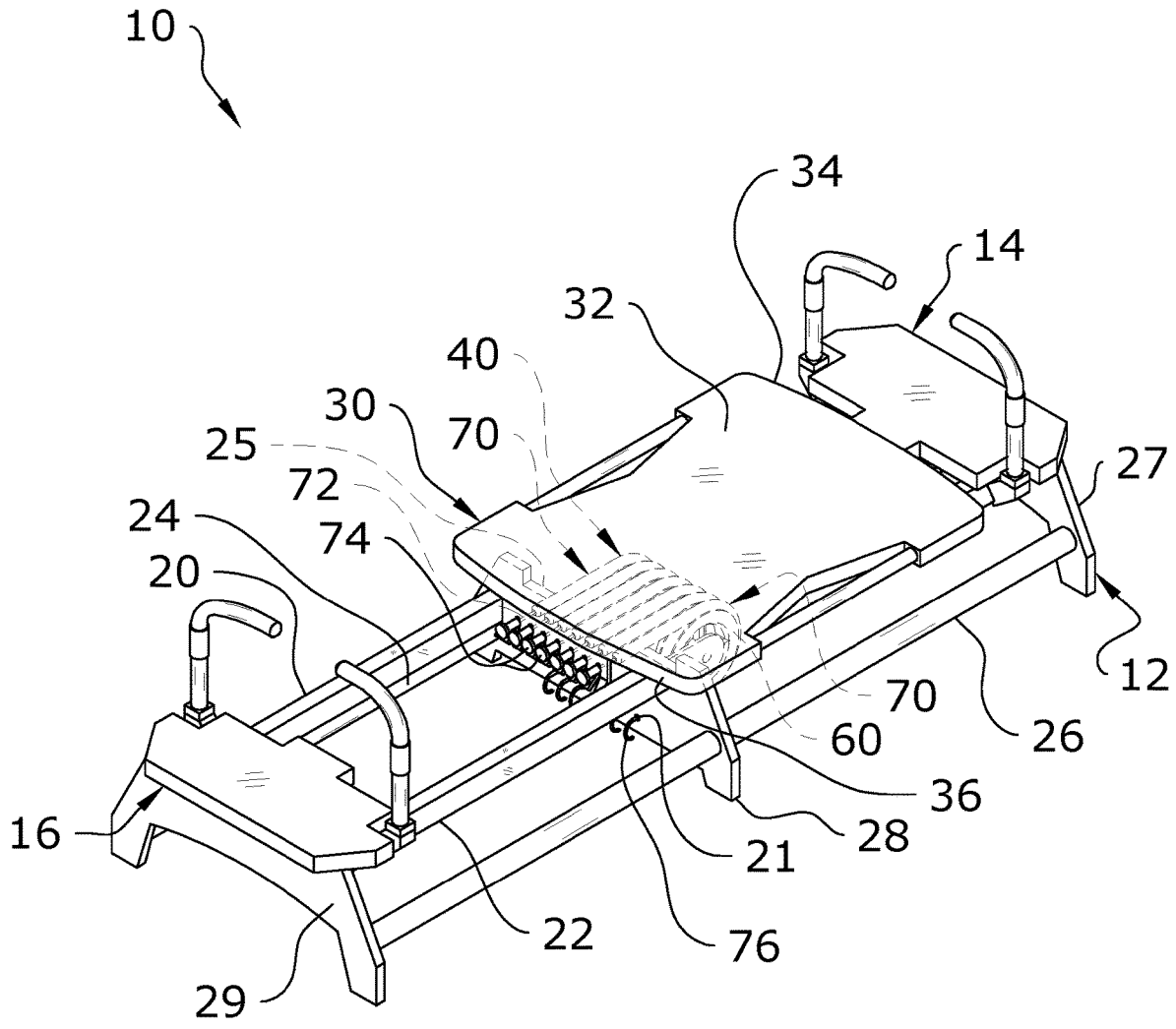
FIG. 1 is an upper perspective view of the present invention with all tension devices connected to the movable platform and the movable platform at the first position.

Turning now descriptively to the drawings, in which similar reference characters denote similar elements throughout the several views, FIGS. 1 through 20 illustrate a frame 12, a platform 32 movably positioned upon the frame 12 and a tension assembly 40 connected between the frame 12 and the platform 32 to provide selective tension upon the platform 32 in a first direction. The tension assembly 40 is comprised of a plurality of pulleys 60 and a plurality of tension devices 70 positioned upon the pulleys 60, wherein the tension devices 70 are attached between a frame 12 and the platform 32. The tension members are selectively engaged to the platform 32 to increase or decrease the tension applied to the platform 32 for varying levels of workouts. The combination of the frame 12 and the platform 32 of the present invention preferably form a Pilates exercise machine.

B. Exercise Machine

FIGS. 1 through 3*b* illustrate an exercise machine 10. The exercise machine 10 is preferably comprised of a Pilates machine but may be comprised of various other types of exercise machines. U.S. Pat. No. 7,803,095 to Lagree illustrates an exemplary Pilates exercise machine and is hereby incorporated by reference in its entirety.

The exercise machine 10 is generally comprised of a frame 12 and a carriage assembly 30 movably positioned upon the frame 12. The user of the exercise machine 10 positions their body (e.g. feet, knees, hands) upon the upper surface or sides of the platform 32. The user then pulls upon cables or pulls/pushes upon handles or end platforms 32 of the exercise machine 10 thereby causing movement of the carriage assembly 30.

Figure 2:
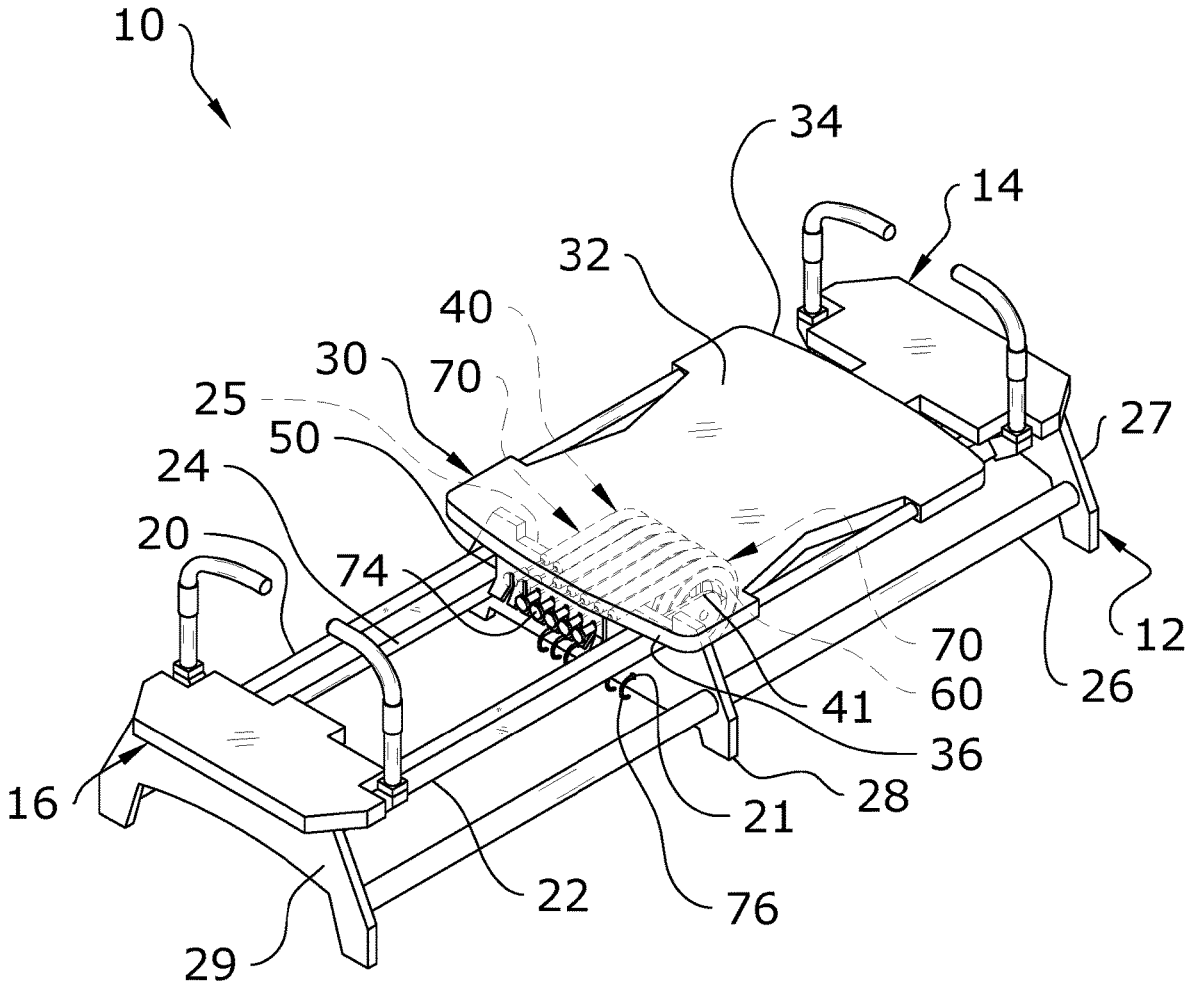
FIG. 2 is an upper perspective view of the present invention with two of the tension devices not connected to the movable platform.

The frame 12 of the exercise machine 10 is preferably comprised of an elongated structure having a first end 14 and a second end 16 as illustrated in FIGS. 1 through 3*b* of the drawings. The frame 12 has a longitudinal axis extending from the first end 14 to the second end 16. FIGS. 1 and 2 illustrate the platform 32 adjacent to the first end 14 of the frame 12. The frame 12 may include a first end member and a second end member attached to the first end 14 and second end 16 respectively for the user to stand or rest their body upon as further shown in FIGS. 1 through 3*b* of the drawings. The frame 12 may be comprised of various types of material such as but not limited to metal, composite, wood, carbon fiber, plastic and the like.

The frame 12 of the exercise machine 10 is preferably comprised of a first member 27 at the first end 14 of the frame 12, a second member 29 at the second end 16 of the frame 12 and an intermediate member 28 between the first member 27 and the second member 29 as illustrated in FIGS. 1 through 3*b*, 18 and 19 of the drawings. The first member 27, the intermediate member 28 and second member 29 are connected together by a first frame member 24 and a second frame member 26 extending between the members 27, 28 and 29. The members 27, 28 and 29 are preferably each comprised of a unitary structure as illustrated in the drawings but may be comprised of more than one component. The members 27, 28 and 29 each preferably have a pair of distal legs that extend downwardly to engage a ground surface and thereby support the frame 12 of the exercise machine 10.

At least one rail 20, 22 is attached to the members 27, 28 and 29 of the frame 12 to movably support the carriage assembly 30. The carriage assembly 30 preferably includes a plurality of wheels extending from the carriage assembly 30 to freely move along the at least one rail 20, 22. The at least one rail 20, 22 is preferably comprised of a first rail 20 and a second rail 22 on opposing sides of the frame 12 of the exercise machine 10. The first rail 20 and the second rail 22 movably support opposing side portions of the carriage assembly 30 along the length of the frame 12. The first rail 20 and the second rail 22 are each preferably parallel with respect to the longitudinal axis of the frame 12. The wheels of the carriage assembly 30 freely ride along the length of the first rail 20 and the second rail 22 thereby allowing the user to perform various types of exercises including Pilates exercises.

C. Carriage Assembly

FIGS. 1 through 4 illustrate the carriage assembly 30 that moves along the frame 12 of the exercise machine 10. The carriage assembly 30 includes a platform 32 movably positioned upon the frame 12 wherein the platform 32 is adapted to be movable along an axis extending between the first end 14 and the second end 16. The carriage assembly 30 includes a plurality of wheels attached to the lower surface or sides of the platform 32 that freely ride along the length of the rails 20, 22 allowing the user to manually push and pull upon the platform 32 with their body.

Figure 16:
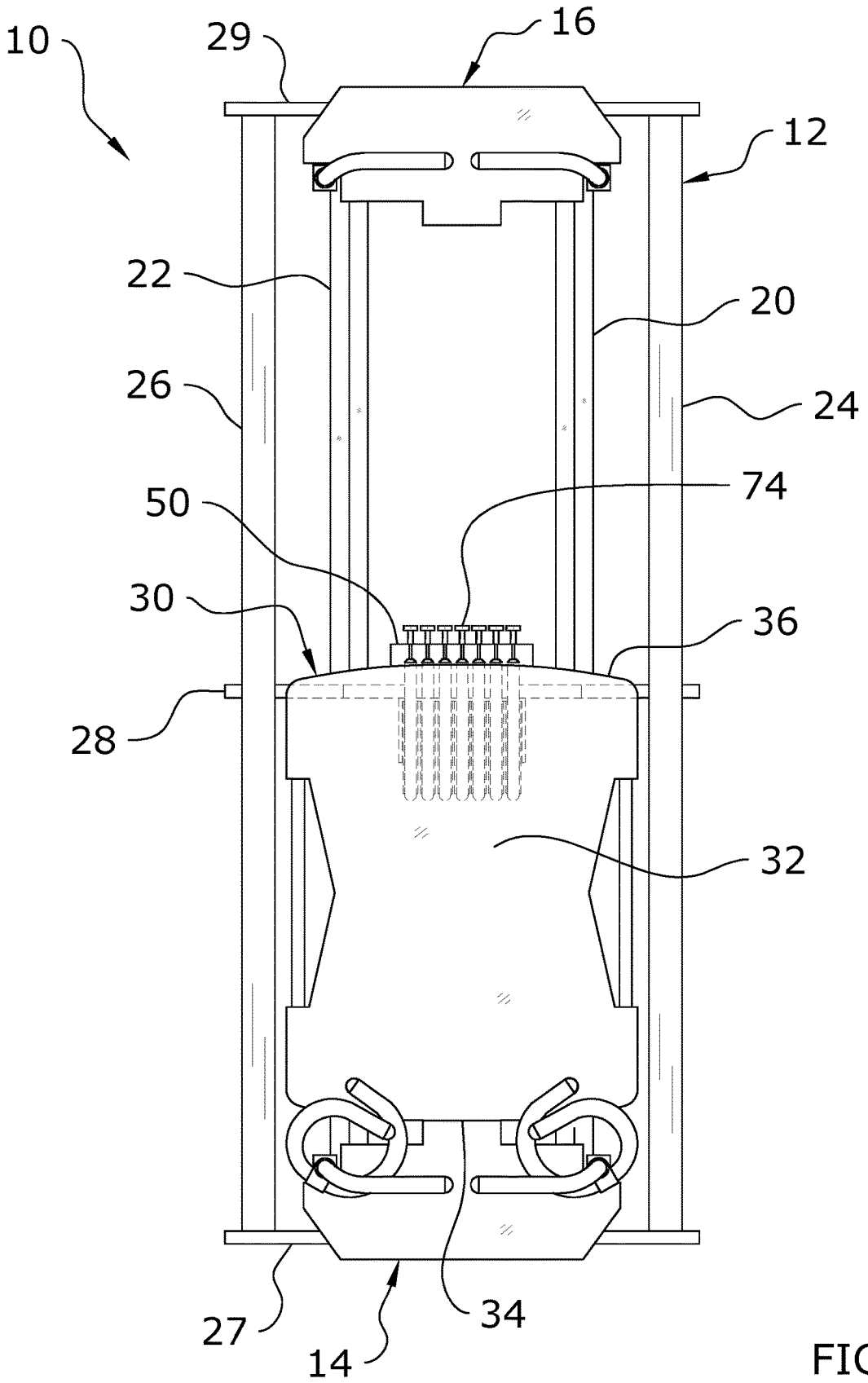
FIG. 16 is a top view of the platform in the first position.

The platform 32 may be comprised of various structures capable of supporting a human during exercises. The platform 32 is preferably a flat structure having a flat upper surface and also having a length that is greater than the width as illustrated in FIG. 16 of the drawings. The platform 32 may be comprised of various types of materials including a cushioned structure.

The platform 32 has a first edge 34 facing the first end 14 of the frame 12 and a second edge 36 facing towards the second end 16 of the frame 12 as illustrated in FIGS. 1 through 3*b* of the drawings. The first edge 34 is on a side of the platform 32 opposite of the second edge 36 and the edges 34, 36 are preferably transverse with respect to the longitudinal axis of the frame 12.

Figure 3A:
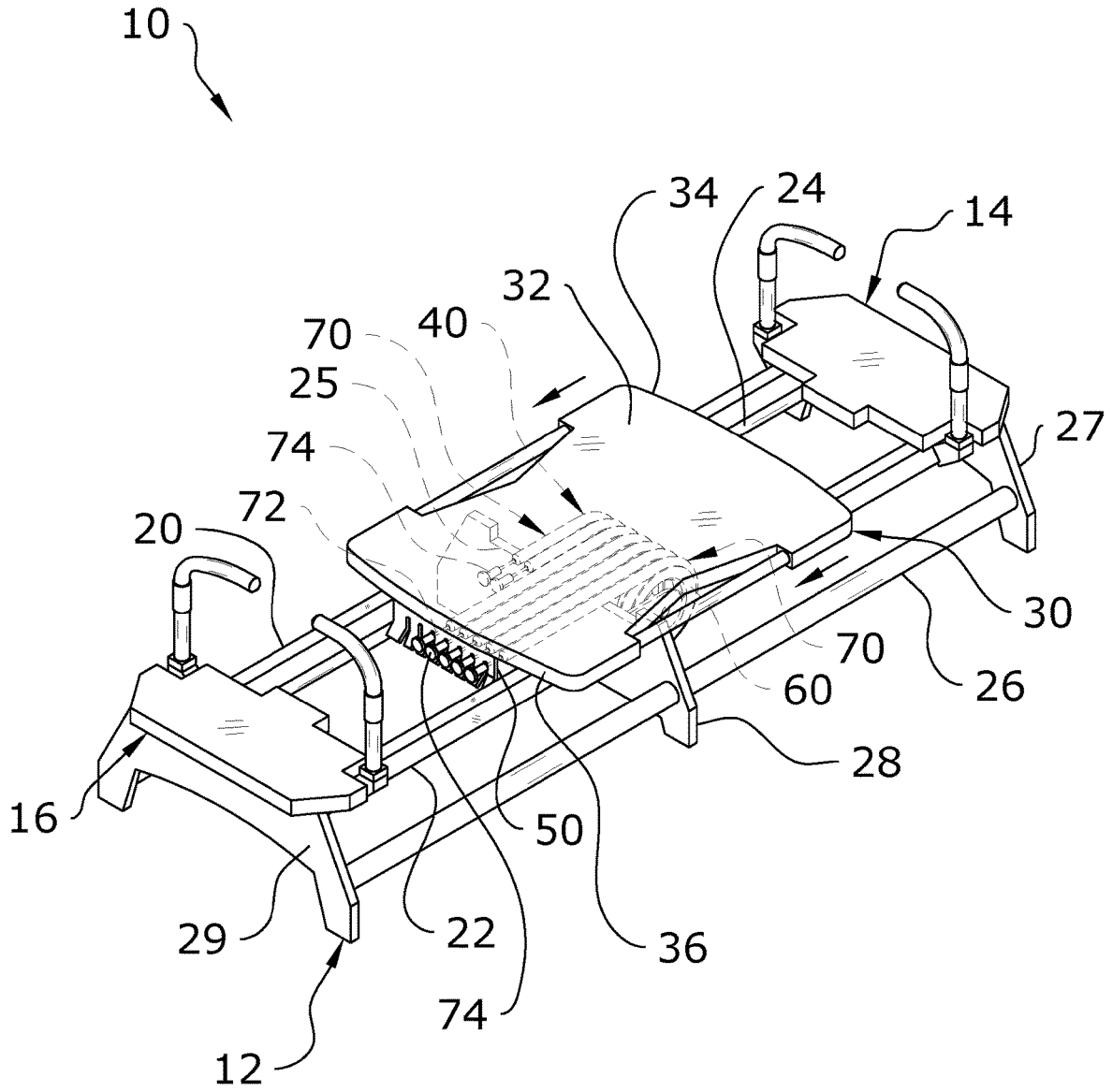
FIG. 3*a* is an upper perspective view with the movable platform moved into an intermediate position.
Figure 3B:
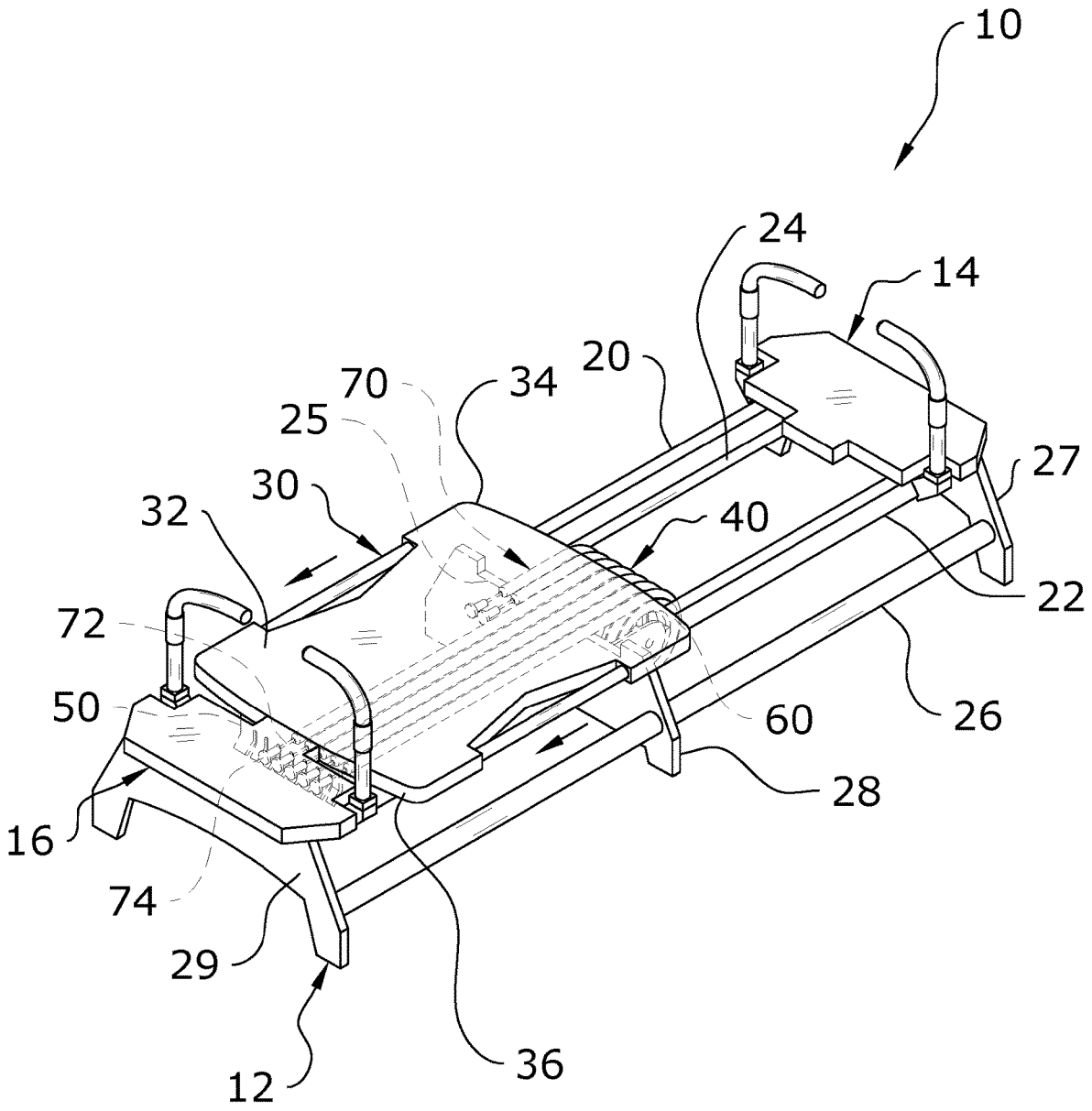
FIG. 3*b* is an upper perspective view with the movable platform moved to the second position.
Figure 17:
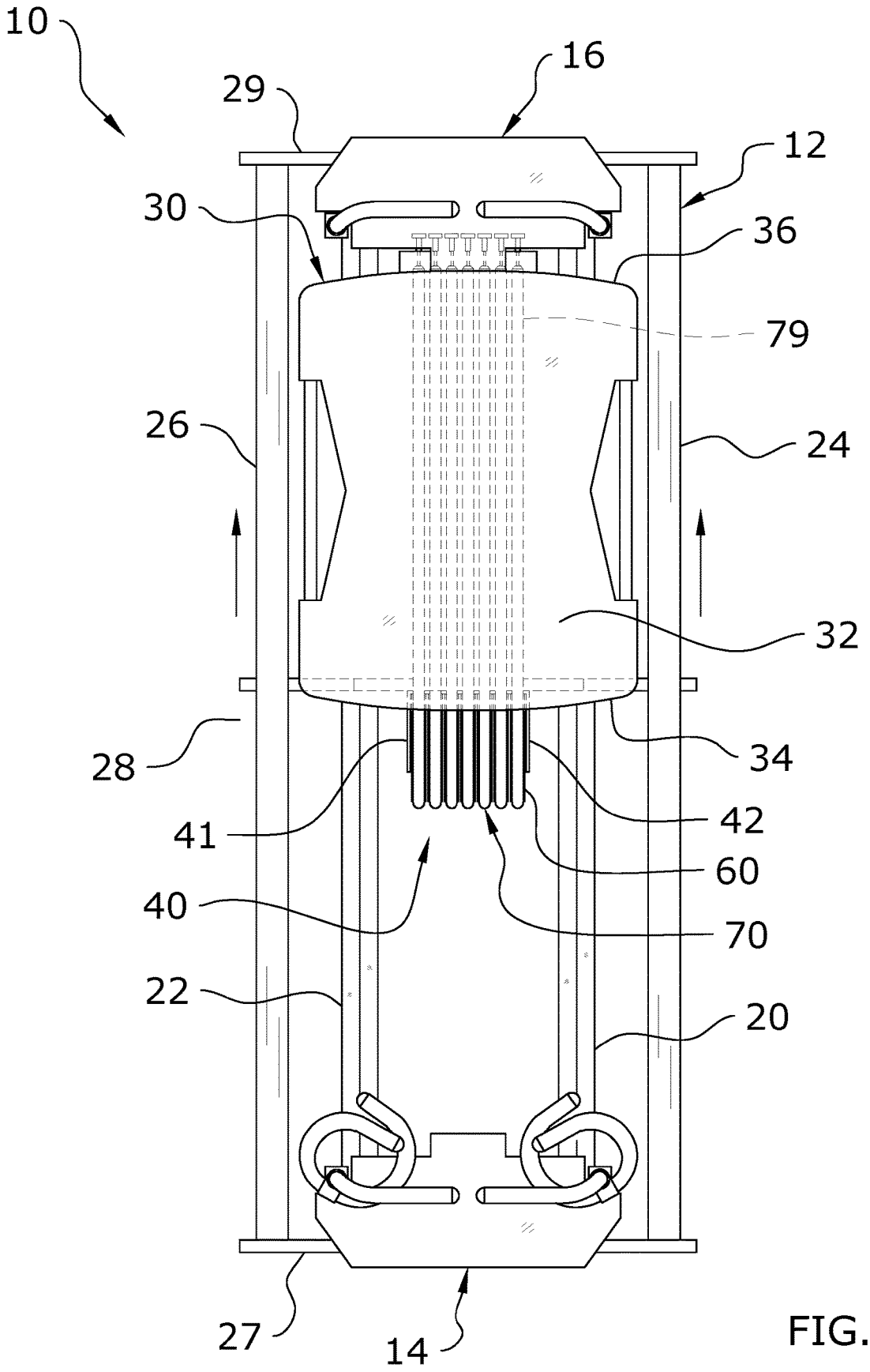
FIG. 17 is a top view of the platform in the second position.
Figure 18:
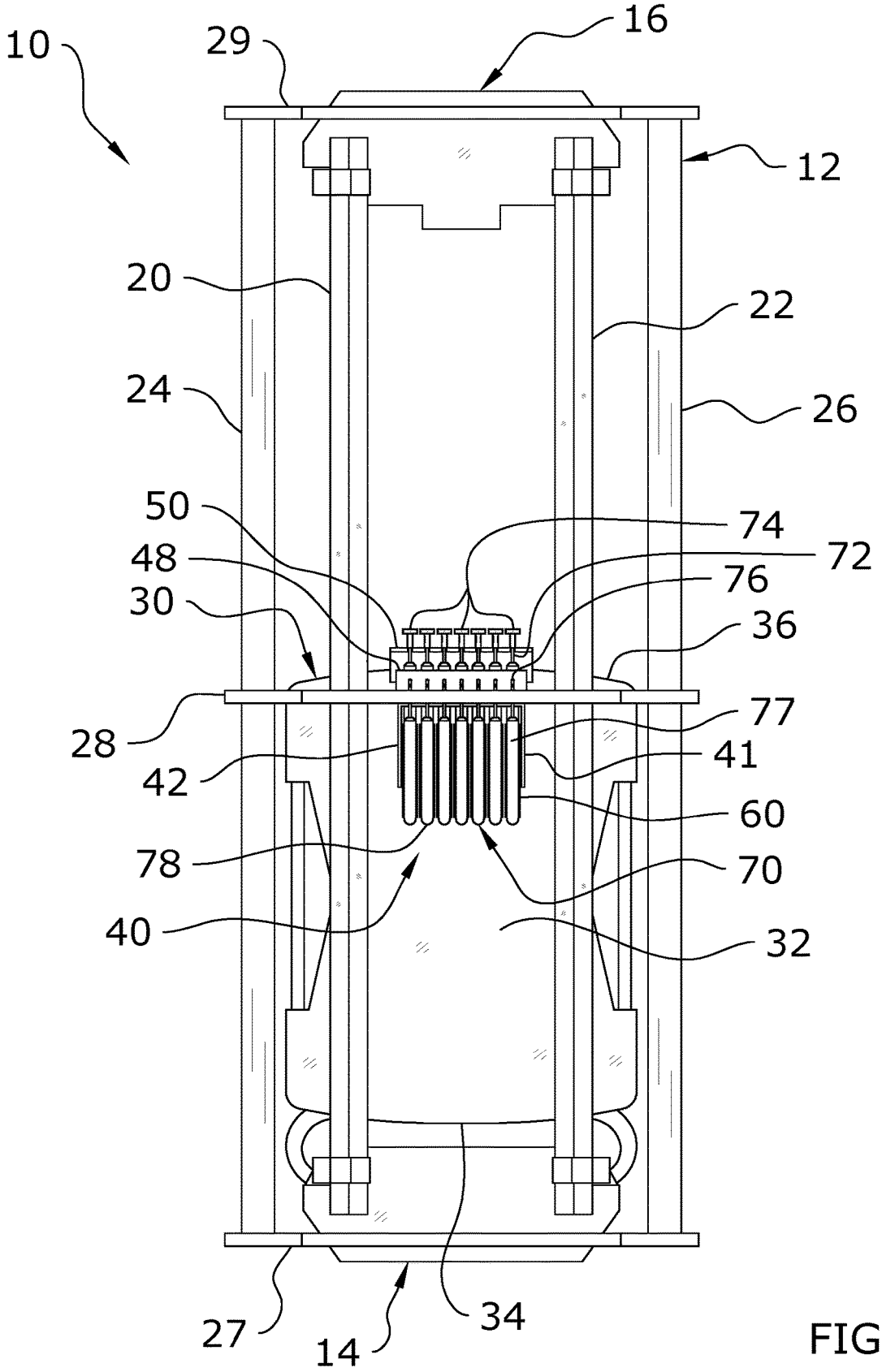
FIG. 18 is a bottom view of the platform in the first position.
Figure 19:
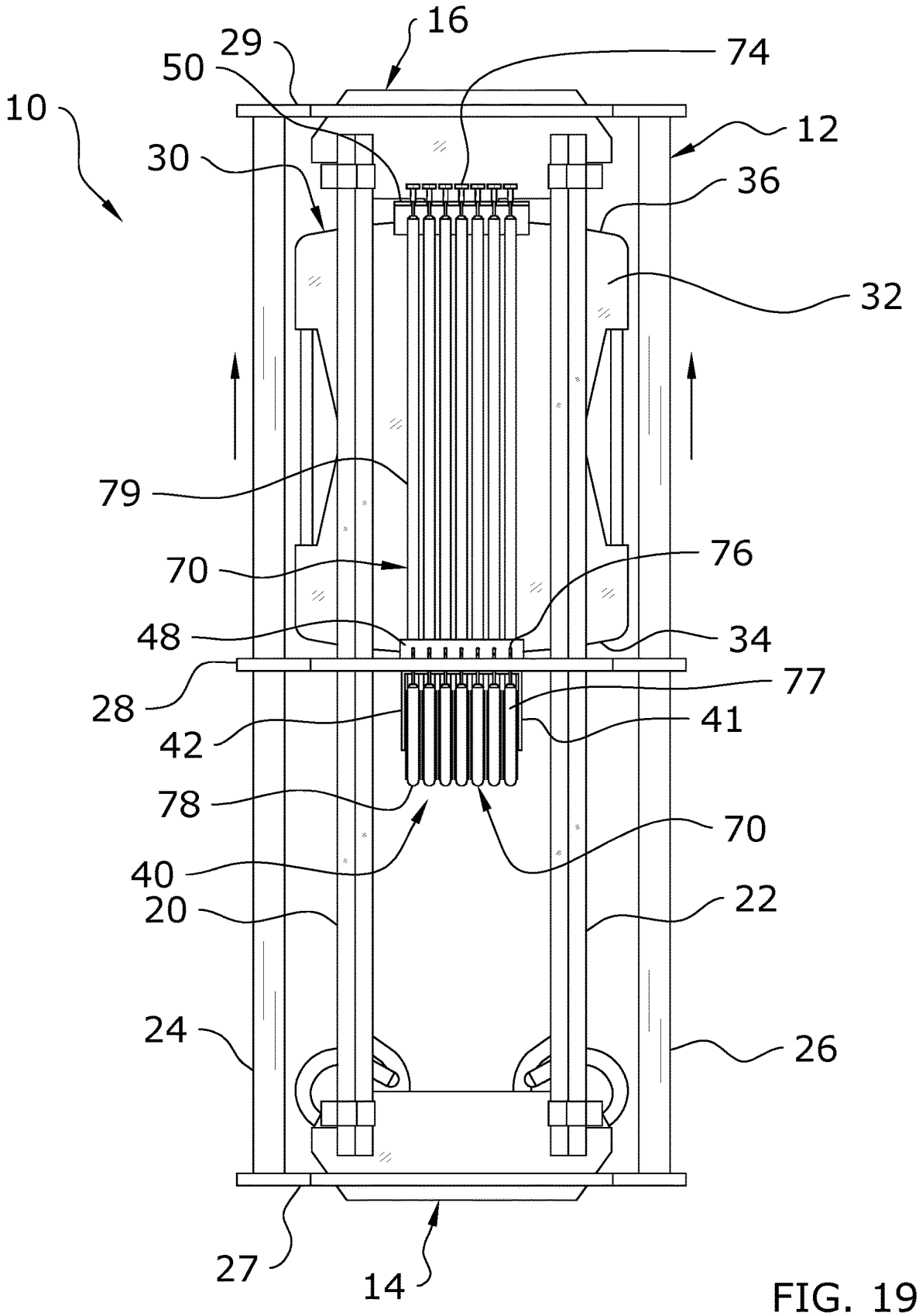
FIG. 19 is a bottom view of the platform in the second position.

The axis of movement for the platform 32 is preferably the longitudinal axis of the frame 12 of the exercise machine 10 with the platform 32 moving from the first end 14 (initial position as shown in FIGS. 1, 2, 16 and 18), to an intermediate position between the first end 14 and second end 16 (an example of an intermediate position is shown in FIG. 3*a*) and to the second end 16 (the final position as shown in FIGS. 3*b*, 17 and 19).

D. Tension Assembly

1. Overview of Tension Assembly.

As illustrated in FIGS. 6 through 11, a tension assembly 40 is provided that is attached to the frame 12 of the exercise machine 10 to provide a tension force to the platform 32 thereby providing resistance to the user as they move the platform 32 away from the first end 14 of the frame 12. The tension force may be variable or constant. The tension force will typically increase as the platform 32 is moved closer to the second end 16 and moved away from the first end 14 of the frame 12. The tension force pulls upon the carriage assembly 30 thereby drawing the platform 32 towards the first end 14 of the frame 12 and away from the second end 16 of the frame 12.

The tension assembly 40 is basically comprised of a plurality of pulleys 60 and a plurality of tension devices 70 wrapped around the plurality of tension devices 70. FIGS. 5 through 8 illustrate the usage of 7 pulleys 60 and 7 corresponding tension devices 70. However, it can be appreciated that the number of pulleys 60 and tension devices 70 may be greater than or less than 7 (e.g. 1, 2, 3, 4, 5, 6, 8, 9, 10, 11 or more). The tension force applied to the platform 32 may be adjusted by selectively engaging one or more of the tension devices 70 within the tension assembly 40.

2. Pulleys.

Figure 15:
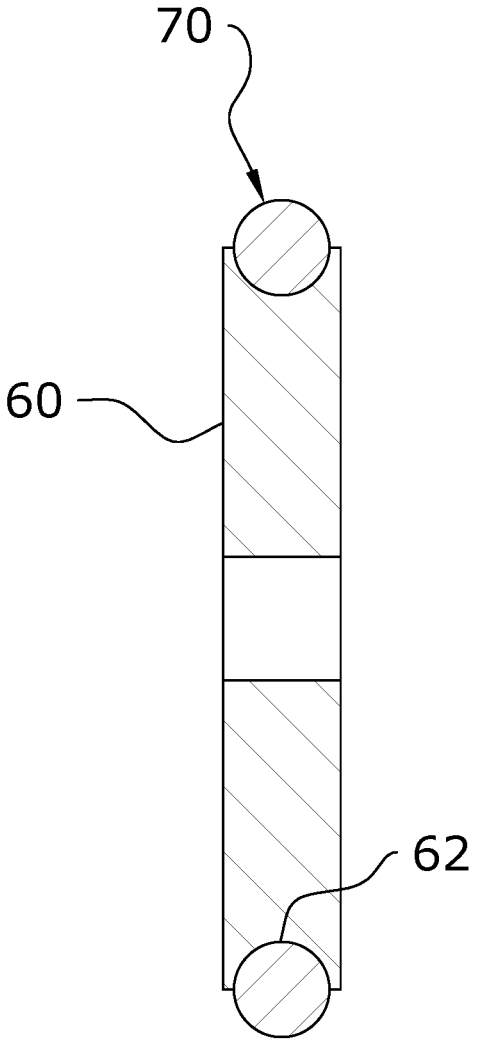
FIG. 15 is a cross sectional view taken along line 15-15 of FIG. 13.

The pulleys 60 are rotatably supported upon the frame 12 to allow for relatively free rotation of the pulleys 60. The pulleys 60 are each circular with an outer rim 62 that rotatably supports the corresponding tension devices 70. The outer rim 62 preferably has two opposing raised edges with the intermediate surface of the outer rim 62 between the outer edges being formed to the shape of the tension device 70 (e.g. for a tension coil spring, the intermediate surface of the rim is preferably curved forming a curved outer channel within the outer rim 62 as illustrated in FIG. 15 of the drawings). The diameter of the pulleys 60 may be comprised of various diameters sufficient to be positioned beneath the carriage assembly 30 and above the floor surface the frame 12 is positioned upon.

The pulleys 60 may be comprised of various types of materials and combinations of materials such as but not limited to plastic, metal, composite, wood and the like. It is preferable to utilize a softer material such as plastic to reduce the noise of the tension devices 70 as they stretch upon the pulleys 60.

Figure 6:
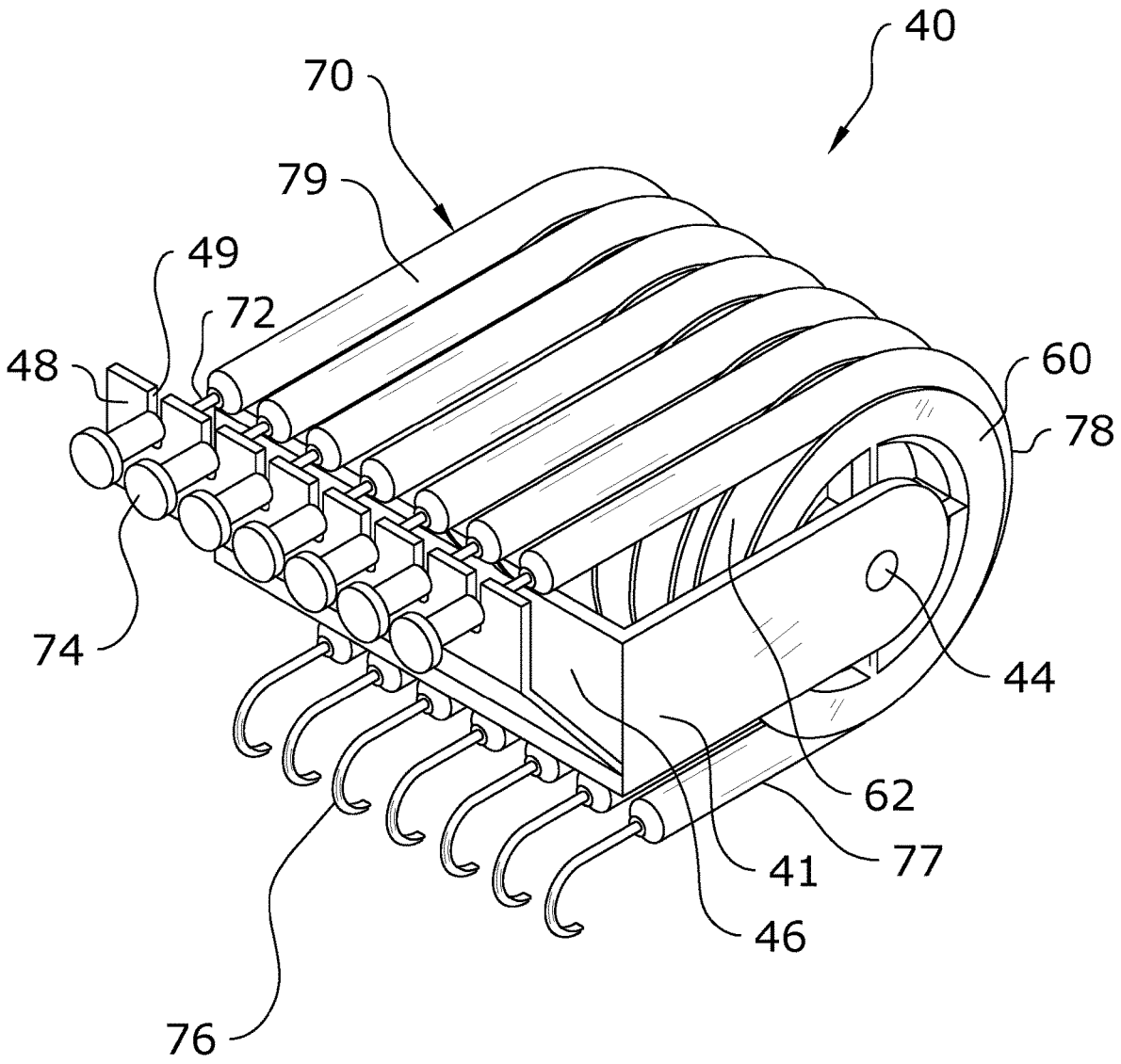
FIG. 6 is a front upper perspective view of the tension assembly.
Figure 7:
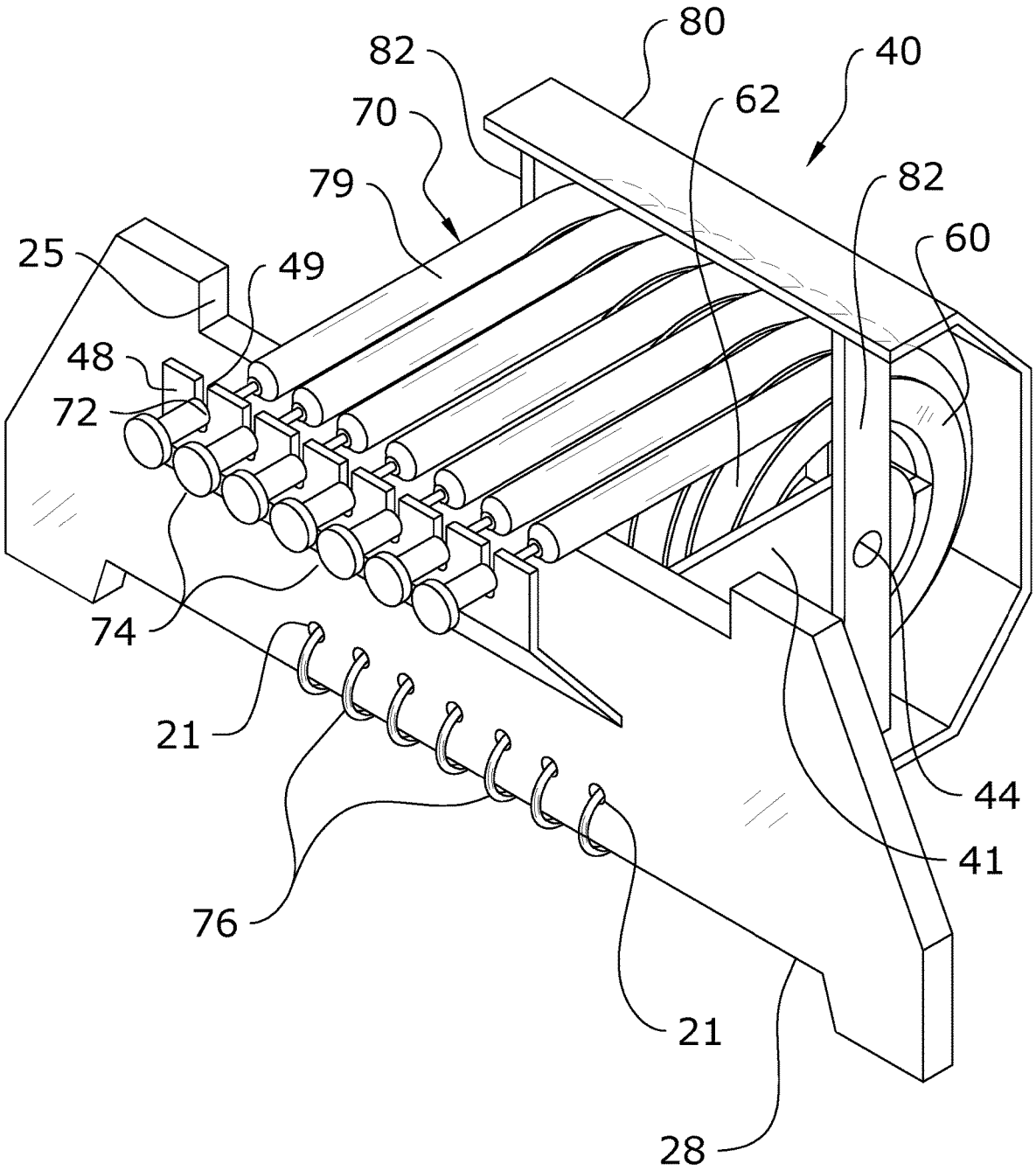
FIG. 7 is a front upper perspective view of the tension assembly with a protective cover.
Figure 8:
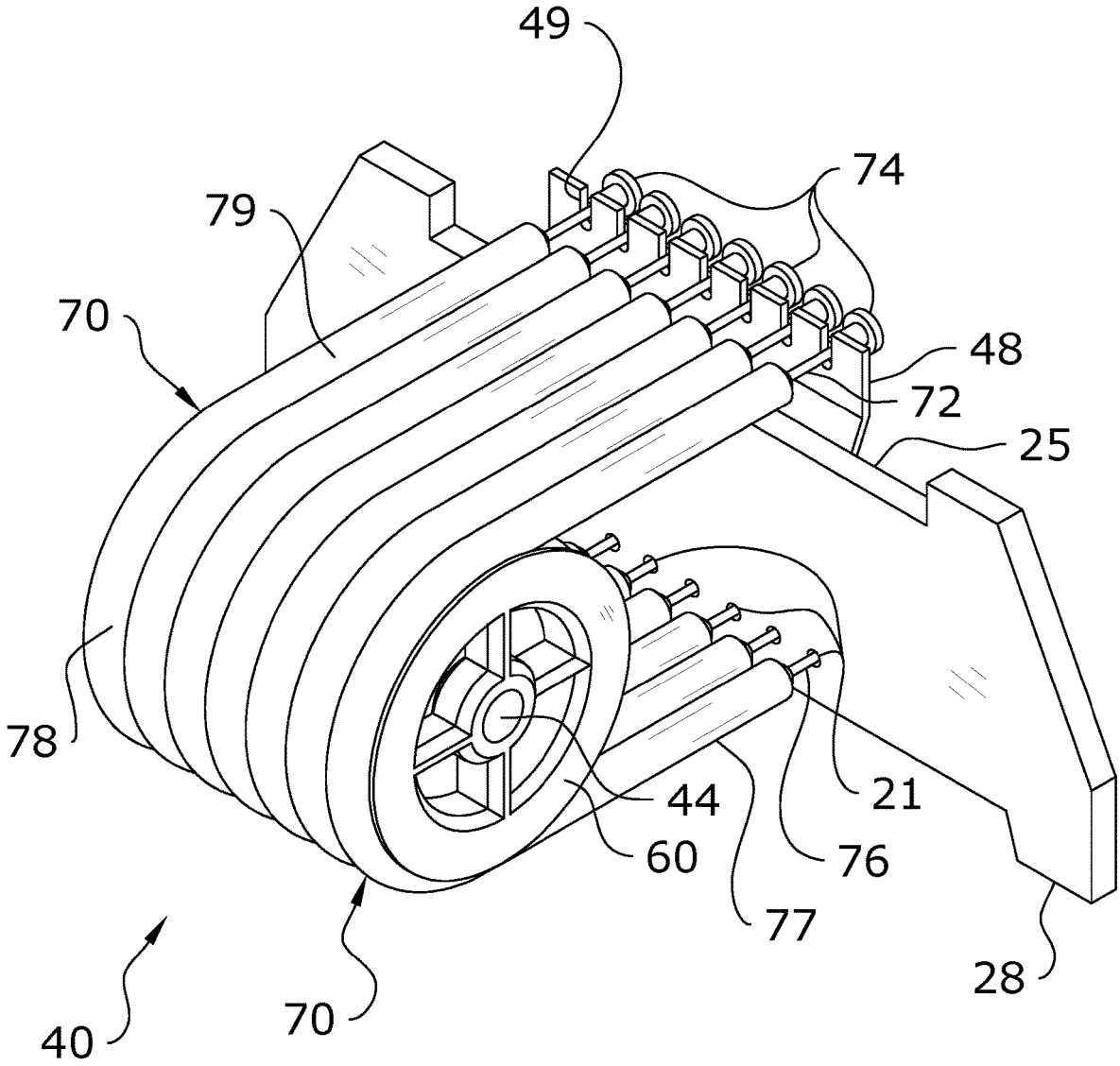
FIG. 8 is a rear upper perspective view of the tension assembly.
Figure 9:
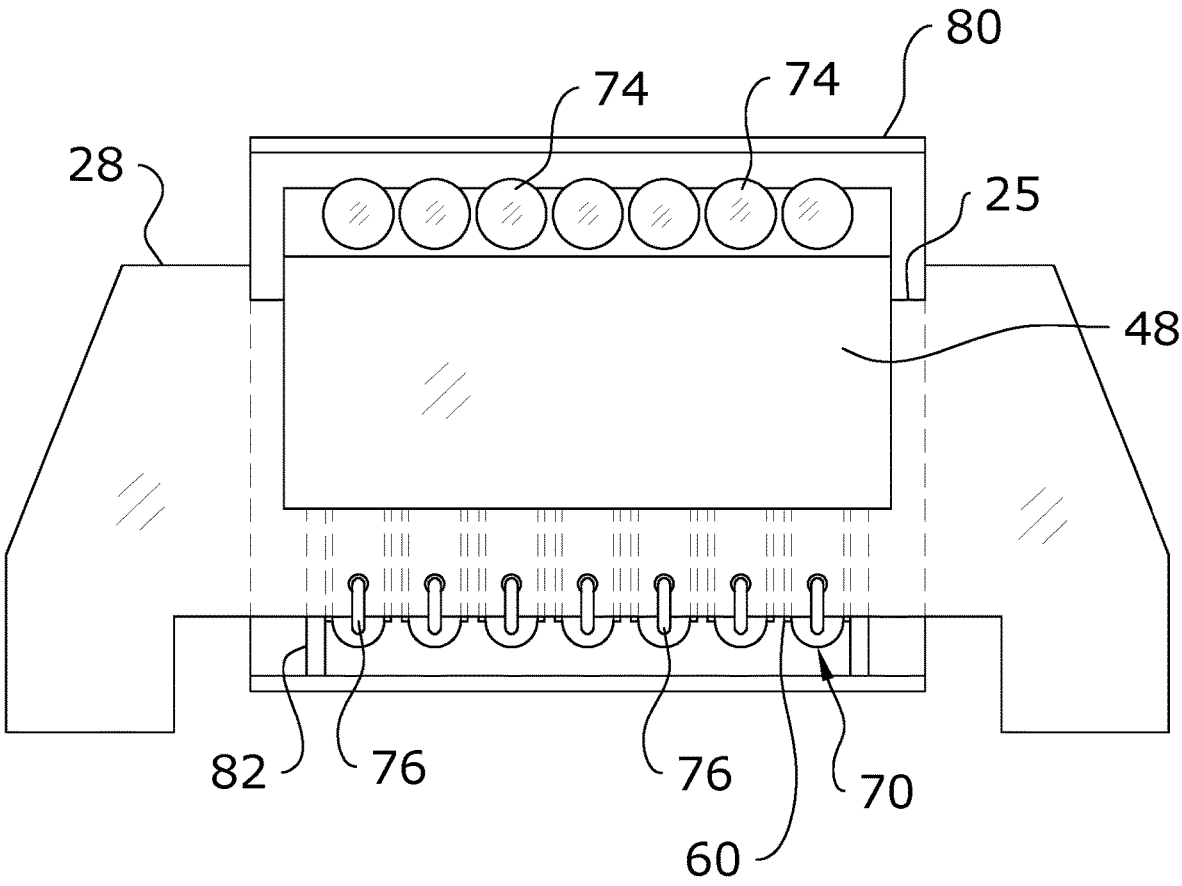
FIG. 9 is a front view of the tension assembly.
Figure 10:
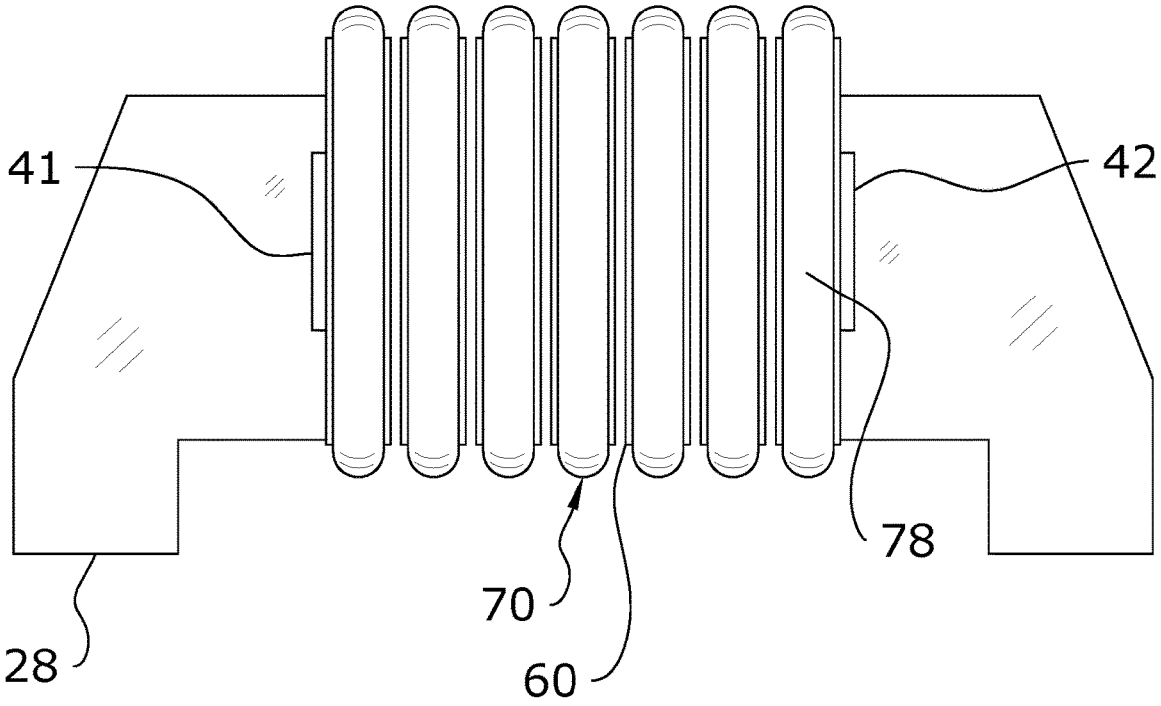
FIG. 10 is a rear view of the tension assembly.
Figure 11:
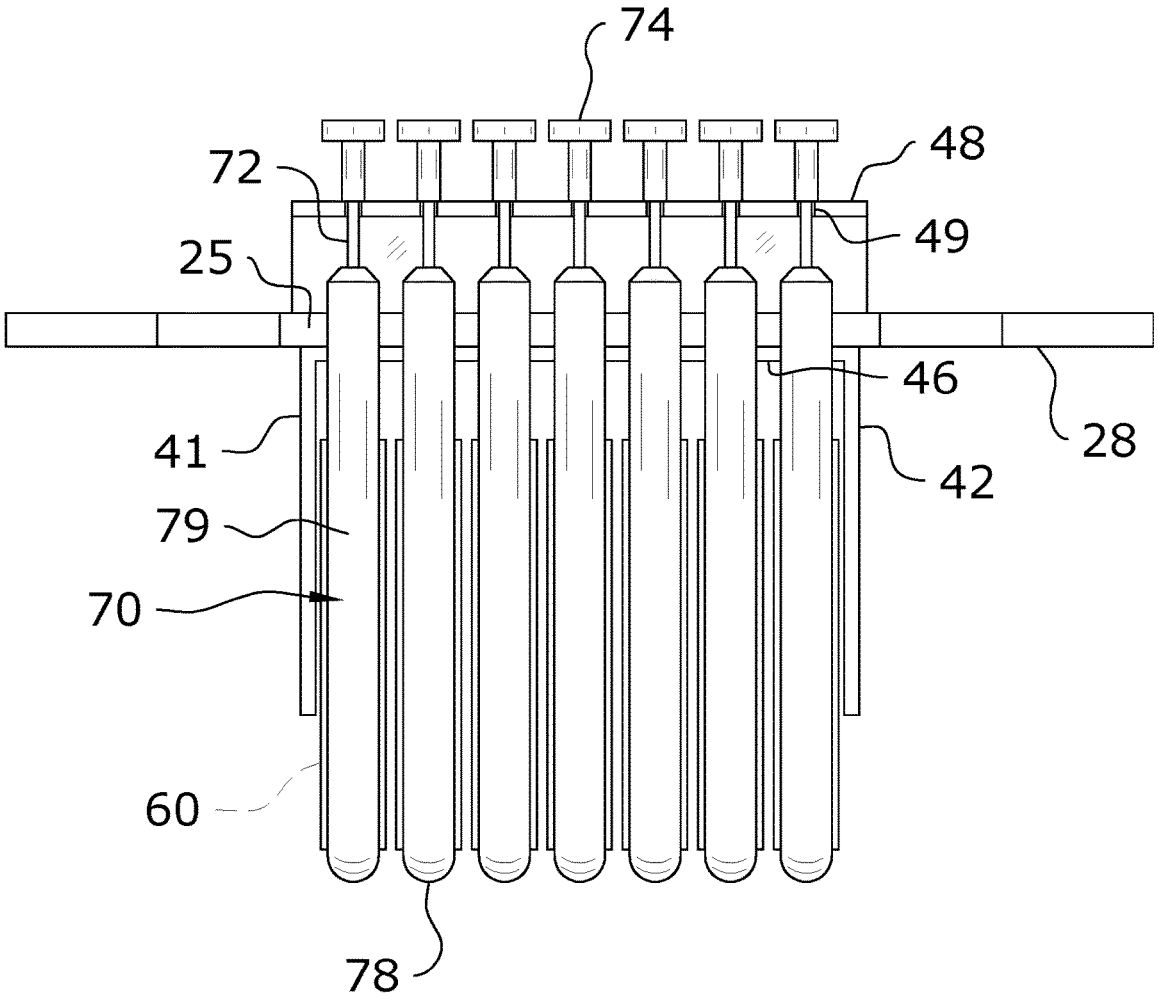
FIG. 11 is a top view of the tension assembly.

The pulleys 60 are preferably supported upon a common concentric axle 44 as illustrated in FIGS. 7 and 8 of the drawings. The axle 44 is preferably transverse with respect to the axis of movement for the platform 32. As shown in FIGS. 6 through 8, a first arm 41 and a second arm 42 support the axle 44 between the distal ends of the arms 41, 42. The arms 41, 42 may be attached directly to the frame 12 (e.g. to the intermediate member 28) or to a cross member 46 extending between the arms 41, 42 wherein the cross member 46 is attached to the frame 12 of the exercise machine 10. As another alternative, the axle 44 may be directly connected to the frame 12 of the exercise machine 10 thereby eliminating the need for the arms 41, 42. Spacers or other separating devices are preferably positioned between each of the pulleys 60 to prevent the pulleys 60 from directly engaging one another allowing them to rotate freely with respect to one another without frictional engagement. Alternatively, the pulleys 60 may be individually supported by an independent suspension system.

The pulleys 60 are preferably parallel to one another and concentrically positioned with respect to one another. The sides of the pulleys 60 are further preferably near one another to create a compact structure for the tension assembly 40. The plurality of pulleys 60 are rotatably supported upon an axle 44 and are preferably independently rotatable with respect to one another. The independent rotation of the pulleys 60 allows for individually selected tension devices 70 to be connected to the platform 32 for stretching with non-selected tension devices 70 remaining in a substantially contracted state.

The pulleys 60 are preferably positioned between the first end 14 and the second end 16 of the frame 12 as illustrated in FIGS. 1 through 4 of the drawings. It is further preferable that the pulleys 60 are near or at a central location between the first end 14 and the second end 16 of the frame 12 as illustrated in FIGS. 1 through 3*b* and 18 of the drawings. The pulleys 60 are preferably positioned beneath the platform 32 when the platform 32 is in the first position (initial position) near the first end 14 of the frame 12 as illustrated in FIG. 16 of the drawings. The pulleys 60 may be exposed partially or in whole when the platform 32 is in the second position (extended position) near the second end 16 of the frame 12 as illustrated in FIG. 17.

A cover 80 may be attached to the frame 12 or axle 44 to cover 80 a portion of the pulleys 60 and tension devices 70 that are exposed when the platform 32 is moved to the second position as illustrated in FIG. 7 of the drawings. The cover 80 preferably has a C-shaped cross sectional shape and extends along the width of the tension assembly 40. The cover 80 wraps around the tension assembly 40 providing sufficient space to prevent engagement of the tension devices 70 with the interior surface of the cover 80 as illustrated in FIG. 15. The cover 80 is supported by a plurality of support members 82 that extend upwardly and downwardly from the axle 44 to support the upper portion and lower portion of the cover 80 as further illustrated in FIG. 7 of the drawings.

3. Tension Devices.

The plurality of tension devices 70 each having a first connecting end attached to the frame 12 and a second connecting end that is adapted for selectively connecting to the platform 32 to allow for one or more of the tension devices 70 to be selectively connected to the platform 32 thereby allowing for adjustment of the tension force applied to the platform 32 by the tension assembly 40. The second connecting end is opposite of the first connecting end. Each of the tension devices 70 may have various cross sectional shapes (e.g. circular as shown in FIG. 15) and various initial contracted lengths (e.g. 3 feet, 4 feet, etc.).

The tension devices 70 are each preferably comprised of an elongated elastic object such as but not limited to springs, tension springs, tension coil springs or elastic bands. The tension devices 70 may each be comprised of the same size, same type, same length and same tension force (e.g. 5 lbs. tension force in the first position and 10 lbs. tension force when stretched to the second position). Each tension device 70 may be comprised of one or more elongated elastic objects such as utilizing two tension coil springs together to form a single tension device 70.

Alternatively, different sizes, different types, different lengths and/or different tension forces may be utilized for the tension devices 70. For example, a first tension device may be comprised of a tension coil spring having an initial tension force of 3 lbs. and a second stretched tension force of 5 lbs. with a second tension device comprised of a tension coil spring having an initial tension force of 6 lbs. and a second stretched tension force of 10 lbs. which allows for incremental adjustment of the tension force applied to the platform 32. To further example, the third tension device may have a different tension force compared to the first tension device and the second tension device. The amount of tension force for each of the tension devices 70 may be indicated by color coding the selection knobs 74 or other indicia.

Figure 20:
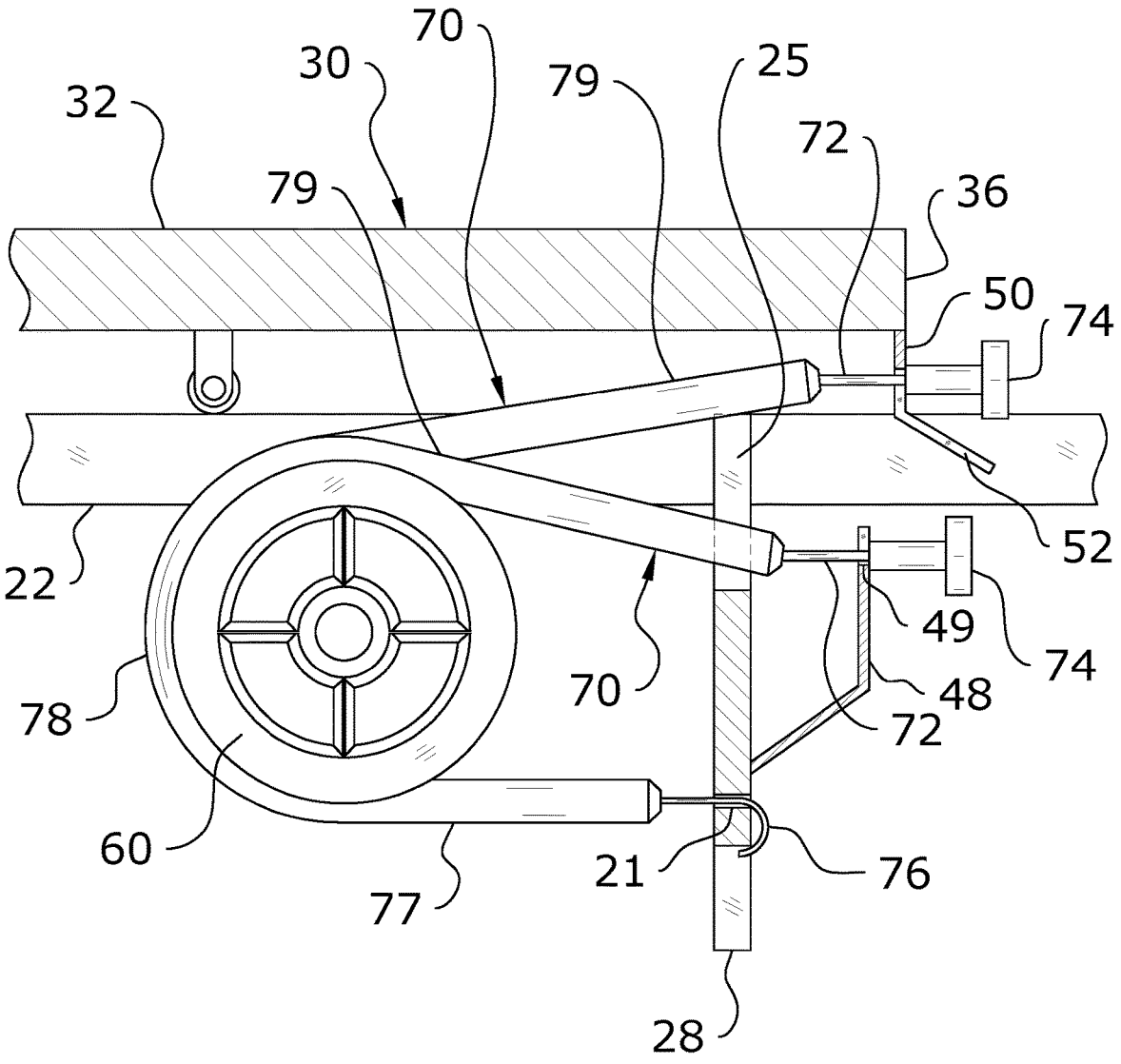
FIG. 20 is a side cutaway view of the tension adjustment assembly.

The tension devices 70 are attached between the frame 12 and the platform 32, with the first connecting end attached to the frame 12 and the second connecting end attached to the platform 32. The first connecting end of the tension devices 70 may be comprised of an engagement member 76 such as but not limited to a hook that extends through corresponding apertures 21 within the intermediate member 28 of the frame 12. The second connecting end of the tension devices 70 is preferably comprised of a selection knob 74 that has an elongated portion with a handle portion at the distal end thereof as best illustrated in FIGS. 6 and 20 of the drawings. It is preferable to have a plurality of non-stretchable elongated members 72 (e.g. cord, cable) extending between the stretchable elastic portion of the tension devices 70 and the selection knobs 74. The elongated members 72 are preferably narrower than the stretchable elastic portion of the tension devices 70 to allow for insertion and removable within slots within the tension adjustment assembly that allows for the selection of which tension devices 70 that are connected to the platform 32 thereby adjusting the amount of tension force applied to the platform 32.

Figure 12:
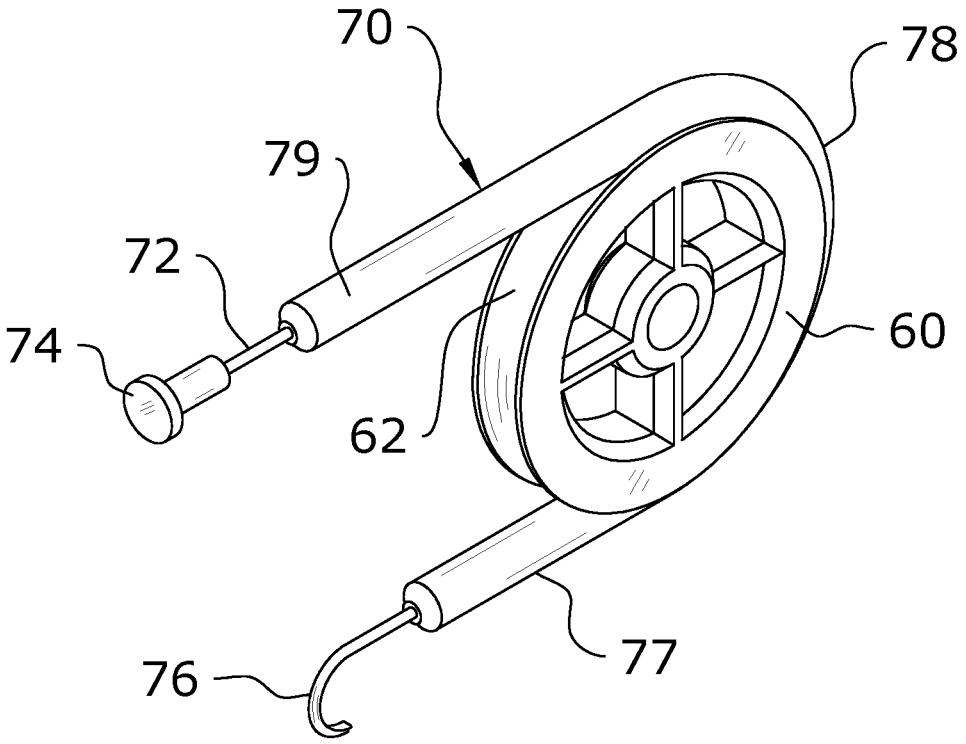
FIG. 12 is an upper perspective view of a tension device wrapped around a pulley in an initial state.
Figure 13:
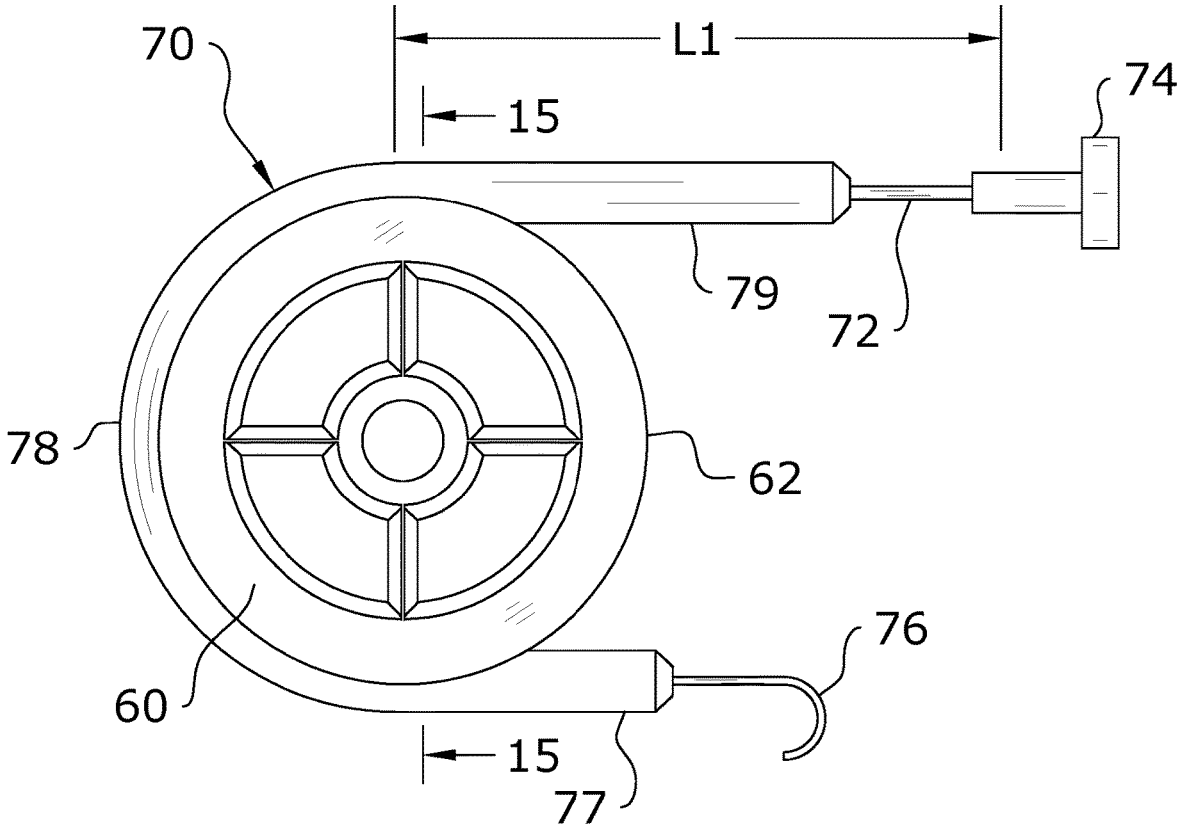
FIG. 13 is a side view of the tension device wrapped around the pulley in the initial state having a length L1 for the first segment.
Figure 14:
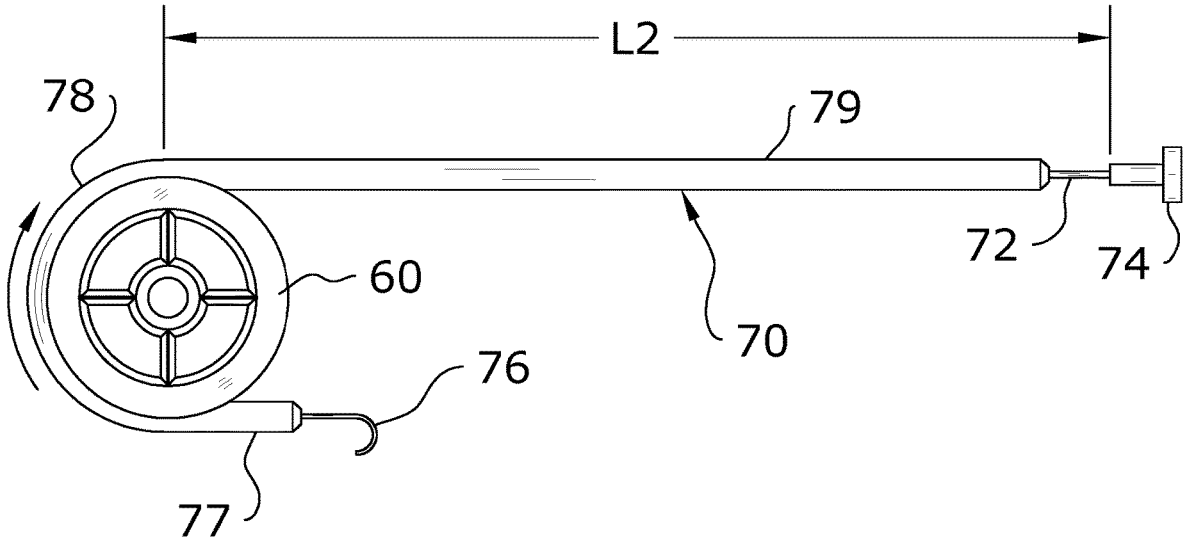
FIG. 14 is a side view of the tension device wrapped around the pulley in the stretched state having a length L2 for the first segment.

The plurality of tension devices 70 are wrapped around the plurality of pulleys 60 as illustrated in FIGS. 5 through 8 and 12 through 14 of the drawings. When the tension devices 70 are wrapped around the pulleys 60, the tension devices 70 are preferably comprised of a U-shaped configuration as best illustrated in FIGS. 12 through 14 of the drawings.

As best illustrated in FIGS. 12 through 14 of the drawings, the tension devices 70 each have a first segment 77 extending from the first connecting end and a second segment 79 extending towards the second connecting end. The first segment 77 of the tension devices 70 is preferably parallel to the second segment 79 as illustrated in FIGS. 13 and 14 of the drawings. In addition, the first segment 77 for each of the tension devices 70 is preferably below the second segment 79. The tension devices 70 each further include an intermediate segment 78 that is adjacent to and in physical contact with the outer rim 62 of a corresponding pulley 60 as illustrated in FIGS. 8, 13, 14 and 15 of the drawings. The intermediate segment 78 is curved having a similar shape as the outer rim 62 of the pulleys 60. The intermediate segment 78 may extend above the outer rim 62 as illustrated in FIG. 14 of the drawings.

The first segment 77 for each of the tension devices 70 stretches in a first direction and the second segment 79 stretches in a second direction which then wraps around the pulleys 60 with the intermediate segment 78 towards the first direction. The first direction of stretching for the tension devices 70 is not the same as the second direction and preferably the first direction is opposite of the second direction of stretching for the tension devices 70. The second direction is preferably opposite of a direction for the tension force applied to the platform 32 by the plurality of tension devices 70.

4. Tension Adjustment Assembly.

FIGS. 4 through 7 and 20 best illustrate the tension adjustment assembly that allows for a user to adjust which of the tension devices 70 are connected to the platform 32 thereby adjusting the amount of tension force applied to the platform 32 to perform various types and levels of exercises. The tension adjustment assembly is preferably comprised of a reserve member 48 connected to the frame 12 and a selection member 50 attached to the platform 32.

The reserve member 48 preferably has a plurality of reserve slots 49 and is attached to the frame 12 (e.g. to the intermediate member 28) or attached to the cross member 46 of the tension assembly 40 as illustrated in FIGS. 5 through 8 of the drawings. The reserve slots 49 within the reserve member 48 receive the selection knobs 74 and the elongated members 72 of the corresponding tension devices 70 that are placed into a reserve position so they are not connected to the platform 32 thereby reducing the amount of tension force applied to the platform 32. The reserve member 48 preferably extends upwardly with the reserve slots 49 extending downwardly into a portion of the reserve member 48 from the upper edge thereof, however various other structures may be utilized for the reserve member 48. The reserve slots 49 are preferably parallel with respect to one another and equidistantly spaced apart.

Figure 4:
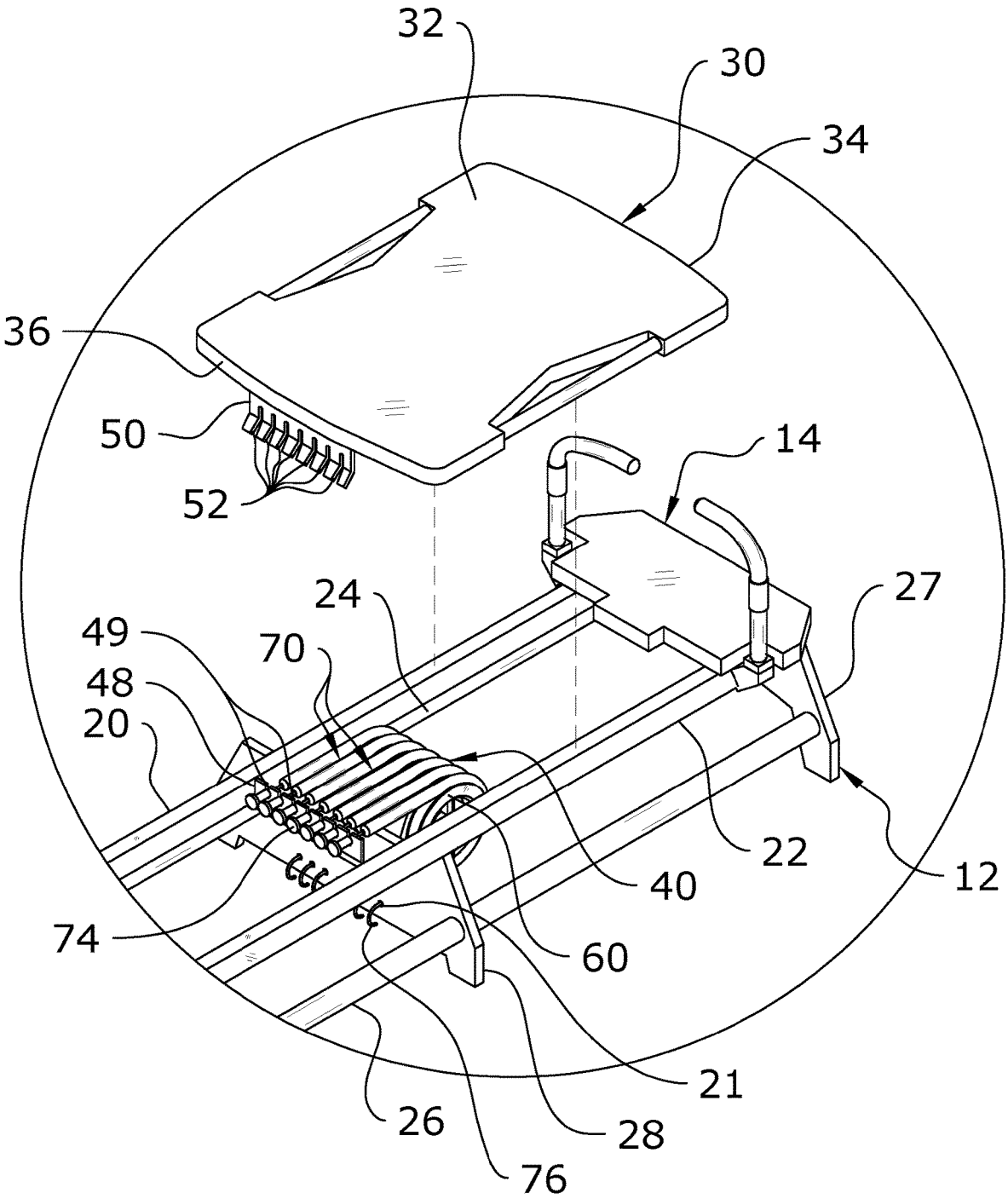
FIG. 4 is an upper perspective view of the platform in an exploded state with respect to the exercise machine.
Figure 5:
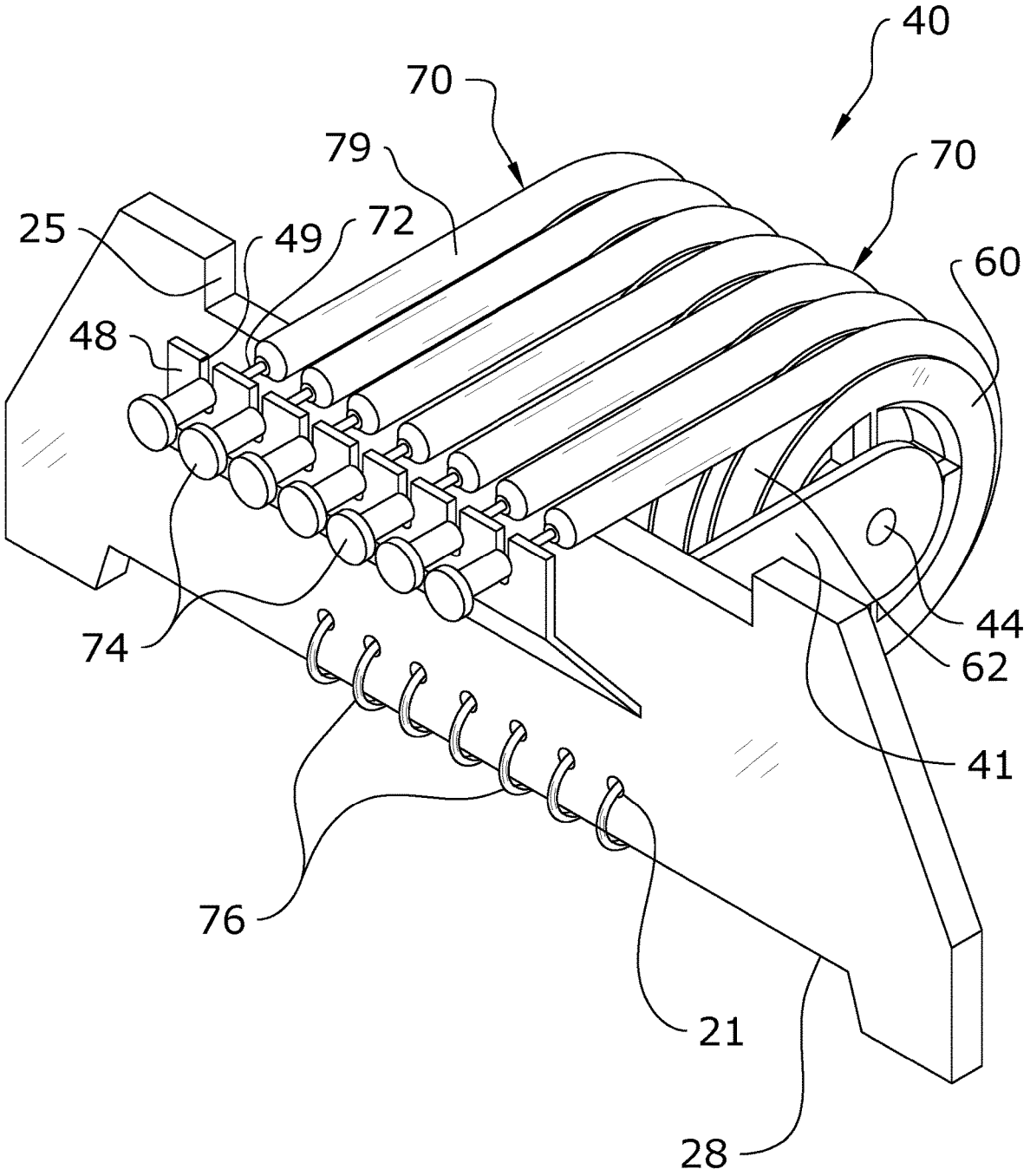
FIG. 5 is a magnified upper perspective view of the tension assembly with respect to the intermediate member.

The selection member 50 preferably has a plurality of selection slots 52 and is attached to the platform 32 as illustrated in FIGS. 4 and 20 of the drawings. The selection member 50 preferably has a downwardly extending vertical portion and then a downwardly angled portion that extends towards the second end 16 of the frame 12 as best illustrated in FIG. 20 of the drawings. The downwardly angled portion of the selection member 50 retains the selection knobs 74 in the selection slots 52 as the user moves the platform 32 by preventing the selection knobs 74 from falling downwardly out of the selection slots 52. The selection slots 52 are preferably parallel with respect to one another and equidistantly spaced part similar to and preferably aligned with the reserve slots 49. The selection slots 52 are preferably positioned above the reserve slots 49 as best illustrated in FIG. 20 of the drawings. The selection slots 52 within the selection member 50 receive the selection knobs 74 and the elongated members 72 of the corresponding tension devices 70 that are placed into a selected position so they are connected to the platform 32 thereby increasing the amount of tension force applied to the platform 32. If the selection knob 74 is not engaged with the selection member 50, the corresponding tension device 70 will not be stretched when the platform 32 is moved from the first position to the second position.

E. Operation of Preferred Embodiment

In use, the user first determines the amount of tension force they would like applied to the platform 32 for a particular exercise to be performed. To adjust the tension force, the user manipulates the selection knobs 74 for each of the corresponding tension devices 70 so that tension devices 70 that are to be connected to the platform 32 have their corresponding selection knobs 74 connected to the selection member 50 and the tension devices 70 that are not to be connected to the platform 32 have their corresponding selection knobs 74 connected to the stationary reserve member 48.

Once the user has adjusted the desired level of tension to be applied to the platform 32, the user then positions their body upon the platform 32 to perform the exercise with the platform 32 in the initial position near the first end 14 as illustrated in FIGS. 1, 16 and 18 of the drawings. The user then moves the platform 32 away from the first end 14 of the frame 12 which causes the tension devices 70 connected to the selection member 50 to stretch. As the tension devices 70 stretch, the amount of tension force is increased. Furthermore, as the tension devices 70 stretch, the first segment 77 and the intermediate segment 78 of the tension devices 70 remain the same length whereas the second segment 79 increases in length from length L1 in FIG. 13 to length L2 in FIG. 14.

As the tension devices 70 stretch or contract, they cause their respective pulley 60 to rotate in a corresponding direction thereby reducing the amount of noise emitted by the tension devices 70 during operation. For example, when the tension device 70 is stretched in FIG. 14 (when the platform 32 moves towards the second end 16 of the frame 12), the pulley 60 is rotated in a clockwise direction. Also, when the tension device 70 is contracted in FIG. 14 (when the platform 32 moves towards the first end 14), the pulley 60 is rotated in a counterclockwise direction. The free rotation of the pulley 60 guides the tension device 70 throughout the entire stretching and contraction of the tension device 70. It can be appreciated that as the tension members stretch that they will have a portion of their respective length sliding along the surface of the outer rim 62.

FIG. 14 illustrates a tension device 70 with the second segment 79 stretched to a length L2 from an original length L1 (see FIG. 13 showing the tension device 70 in the contracted state when the platform 32 is in the initial position near the first end 14). The length L2 varies depending upon the distance the user moves the platform 32 from the first end 14 towards the second end 16 as illustrated in FIGS. 1 through 3*b*, 17 and 19 of the drawings.

As the user moves the platform 32 towards the second end 16, the tension devices 70 connected to the platform 32 stretch and their respective pulleys 60 rotate accordingly (the non-attached tension devices 70 remain in the contracted position and their respective pulleys 60 do not rotate). The tension devices 70 stretch through a recessed portion 25 within an upper portion of the intermediate member 28. As the user moves the platform 32 towards the first end 14, the tension devices 70 connected to the platform 32 contract and their respective pulleys 60 rotate accordingly in a direction opposite of when the tension devices 70 were being stretched (the non-attached tension devices 70 remain in the contracted position and their respective pulleys 60 do not rotate). The platform 32 may be in various intermediate positions between the first end 14 and the second end 16 of the frame 12 as can be appreciated. When the user is finished with the exercise, they return the platform 32 to the first position near the first end 14 and then repeat the above process for the next exercise.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. An exercise machine, comprising:

a frame having a first rail, a first end and a second end;

a first end platform attached to the frame, wherein the first end platform is near the first end of the frame;

a carriage movably positioned upon the first rail, wherein the carriage is adapted to be movable in a reciprocating manner along at least a portion of an axis extending between the first end and the second end of the frame, and wherein the carriage includes a first edge that faces towards the first end of the frame and a second edge that faces towards the second end of the frame;

a first elongated elastic object and a second elongated elastic object each connected to the frame; and a reserve member connected to the frame, wherein the reserve member is below a bottom surface of the carriage, and wherein the reserve member includes a first reserve slot and a second reserve slot;

wherein the first elongated elastic object and the second elongated elastic object are each adapted to be selectively connected to the carriage, wherein the first elongated elastic object applies a first tension force to the carriage when connected to the carriage, and wherein the second elongated elastic object applies a second tension force to the carriage when connected to the carriage;

wherein the first elongated elastic object and the second elongated elastic object are each adapted to be selectively connected to the reserve member within the first reserve slot and the second reserve slot respectively; and wherein the first elongated elastic object includes a first elongated member and a first selection knob coupled to the first elongated member, and the second elongated object includes a second elongated member and a second selection knob coupled to the second elongated member;

wherein the first reserve slot is adapted to receive the first elongated member or the first section knob, and the second reserve slot is adapted to receive the second elongated member or the second selection knob;

wherein the first elongated elastic object is not connected to the carriage when connected to the reserve member;

wherein the second elongated elastic object is not connected to the carriage when connected to the reserve member.

2. The exercise machine of claim 1, wherein the first elongated elastic object and the second elongated elastic object are each comprised of a spring, a tension spring, a tension coil spring or an elastic band.

3. The exercise machine of claim 1, wherein the first tension force and the second tension force are different.

4. The exercise machine of claim 1, wherein the first elongated elastic object and the second elongated elastic object are each adapted to be selectively connected to near the second edge of the carriage.

5. The exercise machine of claim 1, wherein the first edge and the second edge of the carriage are transverse with respect to a longitudinal axis of the frame.

6. The exercise machine of claim 1, including a second end platform attached to the frame, wherein the second end platform is near the second end of the frame.

7. The exercise machine of claim 1, wherein the frame includes a second rail, wherein the first rail is parallel with respect to the second rail, and wherein the carriage is movably positioned upon the first rail and second rail.

8. A method of using the exercise machine of claim 1, comprising:

determining a total tension force to be applied to the carriage; and disconnecting from the reserve member and connecting to the carriage at least one of first elongated elastic object and the second elongated elastic object to apply the total tension force to the carriage.

9. The method of claim 8, comprising moving the carriage away from the first end of the frame against the total tension force.

10. A method of using the exercise machine of claim 1, comprising:

determining a total tension force to be applied to the carriage; and disconnecting from the carriage and connecting to the reserve member at least one of first elongated elastic object and the second elongated elastic object to apply the total tension force to the carriage.

11. The method of claim 10, comprising moving the carriage away from the first end of the frame against the total tension force.

12. An exercise machine, comprising:

a frame having a first rail, a first end and a second end;

a first end platform attached to the frame, wherein the first end platform is near the first end of the frame;

a second end platform attached to the frame, wherein the second end platform is near the second end of the frame;

a carriage movably positioned upon the first rail, wherein the carriage is adapted to be movable in a reciprocating manner along at least a portion of an axis extending between the first end and the second end of the frame, and wherein the carriage includes a first edge that faces towards the first end of the frame and a second edge that faces towards the second end of the frame;

wherein the first edge and the second edge of the carriage are transverse with respect to a longitudinal axis of the frame;

a first elongated elastic object and a second elongated elastic object each connected to the frame; and a reserve member connected to the frame, wherein the reserve member is below a bottom surface of the carriage, and wherein the reserve member includes a first reserve slot and a second reserve slot;

wherein the first elongated elastic object and the second elongated elastic object are each adapted to be selectively connected to the carriage, wherein the first elongated elastic object applies a first tension force to the carriage when connected to the carriage, and wherein the second elongated elastic object applies a second tension force to the carriage when connected to the carriage;

wherein the first elongated elastic object and the second elongated elastic object are each adapted to be selectively connected to the reserve member within the first reserve slot and the second reserve slot respectively; and wherein the first elongated elastic object includes a first elongated member and a first selection knob coupled to the first elongated member, and the second elongated object includes a second elongated member and a second selection knob coupled to the second elongated member;

wherein the first reserve slot is adapted to receive the first elongated member or the first section knob, and the second reserve slot is adapted to receive the second elongated member or the second selection knob;

wherein the first elongated elastic object is not connected to the carriage when connected to the reserve member;

wherein the second elongated elastic object is not connected to the carriage when connected to the reserve member.

13. The exercise machine of claim 12, wherein the first elongated elastic object and the second elongated elastic object are each comprised of a spring, a tension spring, a tension coil spring or an elastic band.

14. The exercise machine of claim 12, wherein the first tension force and the second tension force are different.

15. The exercise machine of claim 12, wherein the first elongated elastic object and the second elongated elastic object are each adapted to be selectively connected to near the second edge of the carriage.

16. The exercise machine of claim 12, wherein the frame includes a second rail, wherein the first rail is parallel with respect to the second rail, and wherein the carriage is movably positioned upon the first rail and second rail.

17. A method of using the exercise machine of claim 12, comprising:

determining a total tension force to be applied to the carriage; and disconnecting from the reserve member and connecting to the carriage at least one of first elongated elastic object and the second elongated elastic object to apply the total tension force to the carriage.

18. The method of claim 17, comprising moving the carriage away from the first end of the frame against the total tension force.

19. An exercise machine, comprising:

a frame having a first rail, a first end and a second end;

a first end platform attached to the frame, wherein the first end platform is near the first end of the frame;

a carriage movably positioned upon the first rail, wherein the carriage is adapted to be movable in a reciprocating manner along at least a portion of an axis extending between the first end and the second end of the frame, and wherein the carriage includes a first edge that faces towards the first end of the frame and a second edge that faces towards the second end of the frame;

wherein the first edge and the second edge of the carriage are transverse with respect to a longitudinal axis of the frame;

a first elongated elastic object and a second elongated elastic object each connected to the frame;

wherein the first elongated elastic object and the second elongated elastic object are each comprised of a spring, a tension spring, a tension coil spring or an elastic band;

wherein the first elongated elastic object has a different tension force than the second elongated elastic object;

wherein the first elongated elastic object and the second elongated elastic object are each adapted to be selectively connected to near the second edge of the carriage; and a reserve member connected to the frame, wherein the reserve member is below a bottom surface of the carriage, and wherein the reserve member includes a first reserve slot and a second reserve slot;

wherein the first elongated elastic object and the second elongated elastic object are each adapted to be selectively connected to the carriage, wherein the first elongated elastic object applies a first tension force to the carriage when connected to the carriage, and wherein the second elongated elastic object applies a second tension force to the carriage when connected to the carriage;

wherein the first elongated elastic object and the second elongated elastic object are each adapted to be selectively connected to the reserve member within the first reserve slot and the second reserve slot respectively; and wherein the first elongated elastic object includes a first elongated member and a first selection knob coupled to the first elongated member, and the second elongated object includes a second elongated member and a second selection knob coupled to the second elongated member;

wherein the first reserve slot is adapted to receive the first elongated member or the first section knob, and the second reserve slot is adapted to receive the second elongated member or the second selection knob;

wherein the first elongated elastic object is not connected to the carriage when connected to the reserve member;

wherein the second elongated elastic object is not connected to the carriage when connected to the reserve member.

20. The exercise machine of claim 19, wherein the frame includes a second rail, wherein the first rail is parallel with respect to the second rail, and wherein the carriage is movably positioned upon the first rail and second rail.

* * * * *